US008528481B2

(12) United States Patent
Scarr

(10) Patent No.: US 8,528,481 B2
(45) Date of Patent: Sep. 10, 2013

(54) LESS LETHAL AMMUNITION

(76) Inventor: Kimball Rustin Scarr, Connersville, IN (US)

( * ) Notice: Subject to any disclaimer, the term of this patent is extended or adjusted under 35 U.S.C. 154(b) by 0 days.

(21) Appl. No.: 13/303,899

(22) Filed: Nov. 23, 2011

(65) Prior Publication Data

US 2012/0060715 A1 Mar. 15, 2012

Related U.S. Application Data

(63) Continuation of application No. 12/342,915, filed on Dec. 23, 2008, now Pat. No. 8,065,961, which is a continuation of application No. 12/233,483, filed on Sep. 18, 2008, now abandoned.

(60) Provisional application No. 60/994,336, filed on Sep. 18, 2007.

(51) Int. Cl.
*F42B 10/36* (2006.01)

(52) U.S. Cl.
USPC ..... 102/503; 102/502; 102/439; 102/520

(58) Field of Classification Search
USPC ..... 102/439, 502, 503, 520, 521, 522, 102/523
See application file for complete search history.

(56) References Cited

U.S. PATENT DOCUMENTS 2,115,028 A * 4/1938 Logan ..... 42/76.01
2,784,711 A 3/1957 Vaughn
2,918,006 A 12/1959 VonZborowski
3,264,776 A 8/1966 Morrow
3,340,769 A * 9/1967 Waser ..... 89/14.5
3,400,661 A * 9/1968 Coon et al. ..... 102/522
3,415,193 A 12/1968 Campagnuolo et al.
3,474,990 A 10/1969 Flatau
3,476,048 A * 11/1969 Barr et al. ..... 102/399
3,493,199 A 2/1970 Flatau
3,526,377 A 9/1970 Flatau
3,584,581 A 6/1971 Flatau et al.
3,585,934 A * 6/1971 Mueller et al. ..... 102/371
3,645,694 A 2/1972 Flatau
3,738,279 A 6/1973 Eyre et al.
3,837,107 A * 9/1974 Swaim et al. ..... 42/105
3,877,383 A 4/1975 Flatau
3,898,932 A 8/1975 Flatau et al.
3,912,197 A 10/1975 McKown et al.

(Continued)

FOREIGN PATENT DOCUMENTS

EP 0 857 940 B1 8/2002
EP 0857940 8/2002

(Continued)

OTHER PUBLICATIONS

U.S. Appl. No. 12/045,647, Notice of Allowance mailed Mar. 21, 2011, 16 pgs.

(Continued)

*Primary Examiner* — James Bergin
(74) *Attorney, Agent, or Firm* — John V. Daniluck; Bingham Greenebaum Doll LLP

(57) ABSTRACT

In one embodiment, a less lethal munition including a ring airfoil projectile. The flight trajectory of the projectile has increased accuracy resulting from the aerodynamic stabilization of the projectile. In some embodiments, the projectile is both aerodynamically stabilized and spin stabilized.

9 Claims, 33 Drawing Sheets

(56) References Cited

U.S. PATENT DOCUMENTS

| | | | | |
|---|---|---|---|---|
| 3,919,799 | A | 11/1975 | Austin, Jr. et al. | |
| 3,951,070 | A | 4/1976 | Flatau et al. | |
| 3,954,057 | A | 5/1976 | Flatau | |
| 3,956,844 | A | 5/1976 | Misevich et al. | |
| 3,980,023 | A | 9/1976 | Misevich | |
| 3,981,093 | A | 9/1976 | Reed | |
| 3,982,489 | A | 9/1976 | Flatau et al. | |
| 4,052,927 | A | 10/1977 | Flatau et al. | |
| 4,132,148 | A * | 1/1979 | Meistring et al. | 89/1.701 |
| 4,151,674 | A | 5/1979 | Klahn et al. | |
| 4,154,012 | A * | 5/1979 | Miller | 42/105 |
| 4,164,904 | A | 8/1979 | Laviolette | |
| 4,190,476 | A | 2/1980 | Flatau et al. | |
| 4,212,244 | A | 7/1980 | Flatau et al. | |
| 4,246,721 | A | 1/1981 | Bowers | |
| 4,262,597 | A | 4/1981 | Olson | |
| 4,270,293 | A | 6/1981 | Plumer et al. | |
| 4,301,736 | A | 11/1981 | Flatau et al. | |
| 4,337,911 | A | 7/1982 | Flatau | |
| 4,390,148 | A | 6/1983 | Cudmore | |
| 4,413,565 | A | 11/1983 | Matthey et al. | |
| 4,539,911 | A | 9/1985 | Flatau | |
| 4,579,059 | A | 4/1986 | Flatau | |
| 4,612,860 | A | 9/1986 | Flatau | |
| 4,656,946 | A | 4/1987 | Gordon et al. | |
| 4,656,947 | A | 4/1987 | Gordon et al. | |
| 4,735,148 | A | 4/1988 | Holtzman | |
| 4,742,774 | A | 5/1988 | Flatau | |
| 4,753,152 | A * | 6/1988 | Baechler | 89/1.701 |
| 4,776,281 | A | 10/1988 | Chiang et al. | |
| 4,790,788 | A | 12/1988 | Hill | |
| 4,827,847 | A | 5/1989 | Laviolette et al. | |
| 4,850,923 | A | 7/1989 | Etheridge | |
| 4,882,997 | A | 11/1989 | Baxter et al. | |
| 4,936,218 | A | 6/1990 | Wosenitz | |
| 4,938,146 | A | 7/1990 | Gunther | |
| 4,969,397 | A | 11/1990 | Gunther | |
| 5,014,624 | A * | 5/1991 | Baxter et al. | 102/503 |
| H0942 | H | 8/1991 | Pardee | |
| 5,067,406 | A | 11/1991 | Olson et al. | |
| 5,275,110 | A | 1/1994 | Flatau | |
| 5,303,632 | A | 4/1994 | Kivity | |
| 5,317,866 | A | 6/1994 | Murray et al. | |
| 5,377,656 | A | 1/1995 | Lewinski et al. | |
| 5,397,261 | A | 3/1995 | Malewicki et al. | |
| 5,515,787 | A | 5/1996 | Middleton | |
| 5,526,749 | A | 6/1996 | Teetzel | |
| 5,531,210 | A | 7/1996 | Meiser et al. | |
| 5,535,729 | A | 7/1996 | Griffin et al. | |
| 5,546,845 | A | 8/1996 | Wossner | |
| 5,655,947 | A | 8/1997 | Chen | |
| 5,677,505 | A | 10/1997 | Dittrich | |
| 5,747,719 | A | 5/1998 | Bottesch | |
| 5,816,880 | A | 10/1998 | Forti et al. | |
| 5,868,597 | A | 2/1999 | Chen | |
| 5,936,189 | A | 8/1999 | Lubbers | |
| 5,970,970 | A | 10/1999 | Vanek et al. | |
| 6,041,712 | A | 3/2000 | Lyon | |
| 6,076,511 | A | 6/2000 | Grimm et al. | |
| 6,079,398 | A | 6/2000 | Grimm | |
| 6,083,127 | A | 7/2000 | O'Shea | |
| 6,145,441 | A | 11/2000 | Woodall et al. | |
| 6,152,123 | A | 11/2000 | Ferrante et al. | |
| 6,178,889 | B1 | 1/2001 | Dindl | |
| 6,220,918 | B1 | 4/2001 | Laronge | |
| 6,257,146 | B1 | 7/2001 | Stonebraker | |
| 6,298,788 | B1 | 10/2001 | Woods | |
| 6,324,983 | B1 | 12/2001 | Dindl | |
| 6,324,984 | B1 | 12/2001 | Dindl | |
| 6,374,741 | B1 | 4/2002 | Stanley | |
| 6,454,623 | B1 | 9/2002 | Flatau | |
| 6,564,719 | B2 | 5/2003 | Saxby | |
| 6,575,098 | B2 | 6/2003 | Hsiung | |
| 6,599,161 | B2 | 7/2003 | Hunter | |
| 6,647,890 | B2 | 11/2003 | Findlay | |
| 6,671,989 | B2 | 1/2004 | Vanek et al. | |
| 6,722,252 | B1 | 4/2004 | O'Dwyer | |
| 6,722,283 | B1 | 4/2004 | Dindl | |
| 6,742,509 | B2 | 6/2004 | Hunter et al. | |
| 6,782,828 | B2 | 8/2004 | Widener | |
| 6,782,829 | B1 | 8/2004 | Han | |
| 6,832,557 | B2 | 12/2004 | Torsten | |
| 6,860,187 | B2 | 3/2005 | O'Dwyer | |
| 6,915,793 | B2 | 7/2005 | Vanek et al. | |
| 6,953,033 | B2 | 10/2005 | Vanek et al. | |
| 6,983,700 | B1 | 1/2006 | Malejko | |
| 6,990,905 | B1 | 1/2006 | Manole | |
| 7,004,074 | B2 | 2/2006 | Van Stratum | |
| 7,007,424 | B2 * | 3/2006 | Vanek et al. | 42/18 |
| 7,021,219 | B1 | 4/2006 | Dindl | |
| D522,070 | S | 5/2006 | Hunter et al. | |
| 7,063,082 | B2 | 6/2006 | Vanek et al. | |
| 7,089,863 | B1 | 8/2006 | Dindl | |
| 7,165,496 | B2 | 1/2007 | Reynolds | |
| 7,191,708 | B2 | 3/2007 | Ouliarin | |
| 7,207,273 | B2 | 4/2007 | Brunn | |
| 7,207,276 | B1 | 4/2007 | Dindl | |
| 7,287,475 | B2 | 10/2007 | Brunn | |
| 7,377,204 | B2 * | 5/2008 | Simmons | 89/8 |
| 7,418,896 | B1 * | 9/2008 | Dindl et al. | 89/1.701 |
| 7,430,825 | B2 * | 10/2008 | Vanek et al. | 42/18 |
| 7,444,941 | B1 | 11/2008 | Brunn | |
| 7,451,702 | B1 | 11/2008 | Dindl | |
| 7,475,638 | B2 | 1/2009 | Haeselich | |
| 7,500,434 | B2 | 3/2009 | Flatau et al. | |
| 7,503,521 | B2 | 3/2009 | Maynard | |
| 7,549,376 | B1 | 6/2009 | Grossman | |
| 7,568,433 | B1 | 8/2009 | Farina | |
| 7,581,500 | B2 | 9/2009 | Flatau | |
| 7,621,208 | B2 | 11/2009 | Huffman | |
| 7,654,458 | B1 | 2/2010 | Kokodis | |
| 7,658,151 | B2 | 2/2010 | Genis | |
| 7,681,503 | B1 | 3/2010 | Fridley | |
| 7,690,310 | B2 | 4/2010 | Engel | |
| 7,793,591 | B1 | 9/2010 | Van Stratum | |
| 7,802,520 | B2 | 9/2010 | Van Stratum | |
| 7,819,065 | B2 | 10/2010 | Haeselich | |
| 7,823,509 | B2 | 11/2010 | Dindl | |
| 7,987,790 | B1 * | 8/2011 | Scarr | 102/503 |
| 8,065,961 | B1 * | 11/2011 | Scarr | 102/503 |
| 8,327,768 | B2 * | 12/2012 | Scarr | 102/503 |
| 2002/0088367 | A1 | 7/2002 | MacAleese | |
| 2003/0000122 | A1 | 1/2003 | Vanek et al. | |
| 2003/0089221 | A1 * | 5/2003 | O'Dwyer | 89/14.6 |
| 2003/0097952 | A1 | 5/2003 | Findlay | |
| 2004/0000250 | A1 | 1/2004 | Stratum | |
| 2005/0066843 | A1 | 3/2005 | Flatau et al. | |
| 2005/0183615 | A1 | 8/2005 | Flatau | |
| 2006/0096492 | A1 | 5/2006 | Flatau et al. | |
| 2007/0079819 | A1 | 4/2007 | Vanek et al. | |
| 2008/0006171 | A1 | 1/2008 | Confer | |
| 2008/0223246 | A1 | 9/2008 | Dindl | |
| 2010/0089226 | A1 | 4/2010 | Jones | |
| 2010/0095863 | A1 | 4/2010 | Kolnik | |
| 2010/0101443 | A1 | 4/2010 | Rosales | |
| 2010/0132580 | A1 | 6/2010 | Nazdratenko | |
| 2010/0212533 | A1 | 8/2010 | Brunn | |
| 2010/0263568 | A1 | 10/2010 | Huffman | |
| 2010/0282118 | A1 | 11/2010 | Ladyjensky | |

FOREIGN PATENT DOCUMENTS

| | | |
|---|---|---|
| EP | 1 228 342 B1 | 7/2003 |
| EP | 1228342 | 7/2003 |
| EP | 1 376 046 A1 | 1/2004 |
| EP | 1376046 | 1/2004 |
| EP | 1 104 541 B1 | 3/2004 |
| EP | 1104541 | 3/2004 |
| EP | 0 966 650 B1 | 9/2005 |
| EP | 0966650 | 9/2005 |
| EP | 1 079 199 B1 | 10/2005 |
| EP | 1079199 | 10/2005 |
| WO | 8101046 | 4/1981 |
| WO | 8707708 | 12/1987 |
| WO | 9853269 | 11/1998 |

| | | | |
|---|---|---|---|
| WO | 9937968 | | 7/1999 |
| WO | 2006083280 | | 8/2006 |
| WO | 2006092637 | | 9/2006 |
| WO | 2008020857 | | 2/2008 |
| WO | WO 2008/020857 | A2 | 2/2008 |
| WO | 2008045131 | | 4/2008 |
| WO | WO 2008/045131 | | 4/2008 |
| WO | 2008099353 | | 8/2008 |
| WO | 2009048664 | | 4/2009 |
| WO | 2009137370 | | 11/2009 |

OTHER PUBLICATIONS

U.S. Appl. No. 12/045,647, Office Action mailed Jun. 11, 2010, 29 pgs.
U.S. Appl. No. 12/045,647, Response filed Dec. 13, 2010, 38 pgs.
U.S. Appl. No. 12/181,190, Office Action mailed Oct. 4, 2010, 8 pgs.
U.S. Appl. No. 12/181,190, Response filed Apr. 4, 2011, 36 pgs.
USPTO, NF Rejection, U.S. Appl. No. 10/803,260, Oct. 16, 2007, 7 pages.
USPTO, NF Rejection, U.S. Appl. No. 12/045,647, Jun. 11, 2010, 29 pages.
Applicant Response, U.S. Appl. No. 12/045,647, Dec. 13, 2010, 38 pages.
USPTO, Notice of Allowance, U.S. Appl. No. 12/045,647, Mar. 21, 2011, 5 pages.
USPTO, U.S. Appl. No. 12/181,190, filed Oct. 4, 2010, 8 pages.
Applicant Response, U.S. Appl. No. 12/181,190, Apr. 4, 2011, 36 pages.
NF Rejection, U.S. Appl. No. 12/342,915, Dec. 3, 2010, 5 pages.
Applicant Response, U.S. Appl. No. 12/342,915, May 3, 2011, 16 pages.
USPTO, Notice of Allowance, Jul. 26, 2011, 5 pages.
USPTO, NF Rejection, U.S. Appl. No. 13/189,147, Apr. 6, 2012, 5 pages.
Applicant Response, U.S. Appl. No. 13/189,147, Jul. 31, 2012, 15 pages.
Notice of Allowance, U.S. Appl. No. 13/189,147, Aug. 10, 2012, 6 pages.

* cited by examiner

LESS LETHAL AMMUNITION

CROSS REFERENCE TO RELATED APPLICATIONS

This application is a continuation application of U.S. patent application Ser. No. 12/342,915, filed Dec. 23, 2008, now issued as U.S. Pat. No. 8,065,961, which is a continuation of U.S. patent application Ser. No. 12/233,483, filed Sep. 18, 2008, entitled LESS LETHAL AMMUNITION, now abandoned, which claims the benefit of priority to U.S. Provisional Patent Application Ser. No. 60/994,336 filed Sep. 18, 2007, entitled RING AIRFOIL GLIDER AMMUNITION LESS LETHAL, all of which are incorporated herein by reference.

FIELD OF THE INVENTION

The present invention pertains to ammunition, and in particular to less-lethal munitions incorporating sub-caliber projectiles.

SUMMARY OF THE INVENTION

One aspect of the present invention pertains to embodiments including a sabot for pushing a projectile such that the projectile exits the muzzle of the gun with the sabot being retained within the barrel.

Yet another aspect of the present invention pertains to a multi-piece sabot, in which a portion of the sabot pushes a projectile, and a portion of the sabot (either the same portion or a different portion) is ejected from the muzzle of the gun barrel.

Yet another aspect of some embodiments of the present invention pertain to methods and apparatus for linking together multiple munitions for semi-automatic or automatic firing of the munitions.

It will be appreciated that the various apparatus and methods described in this summary section, as well as elsewhere in this application, can be expressed as a large number of different combinations and subcombinations. All such useful, novel, and inventive combinations and subcombinations are contemplated herein, it being recognized that the explicit expression of each of these myriad combinations is excessive and unnecessary.

These and other aspects and features of various embodiments will be shown in the drawings, claims, and text that follows.

BRIEF DESCRIPTION OF THE DRAWINGS

FIG. 10 is an elevated cross sectional view of a round according to another embodiment of the present invention.

DESCRIPTION OF THE PREFERRED EMBODIMENT

Figure 1A:
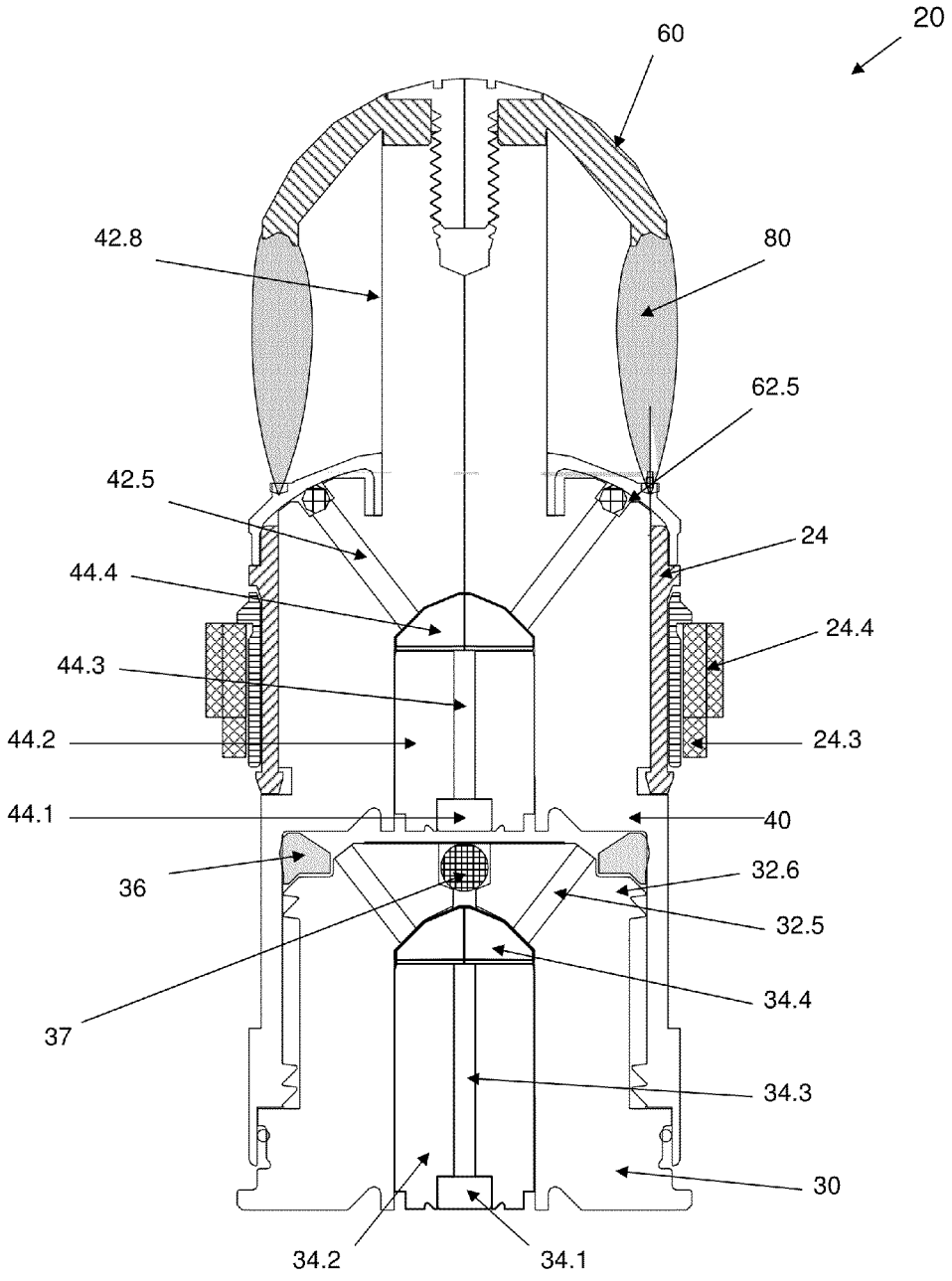
FIG. 1*a* is a cross sectional elevated view of ammunition according to one embodiment of the present invention.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

The use of an N-series prefix for an element number (NXX.XX) refers to an element that is the same as the non-prefixed element (XX.XX), except as shown and described thereafter. As an example, an element 1020.1 would be the same as element 20.1, except for those different features of element 1020.1 shown and described. Further, common elements and common features of related elements are drawn in the same manner in different figures, and/or use the same symbology in different figures. As such, it is not necessary to describe the features of 1020.1 and 20.1 that are the same, since these common features are apparent to a person of ordinary skill in the related field of technology. Although various specific quantities (spatial dimensions, temperatures, pressures, times, force, resistance, current, voltage, concentrations, etc.) may be stated herein, such specific quantities are presented as examples only, and are not to be construed as limiting.

Incorporated herein by reference are U.S. patent application Ser. Nos. 12/045,647, filed Mar. 10, 2008; and 12/181,190, filed Jul. 28, 2008.

Figure 1B:
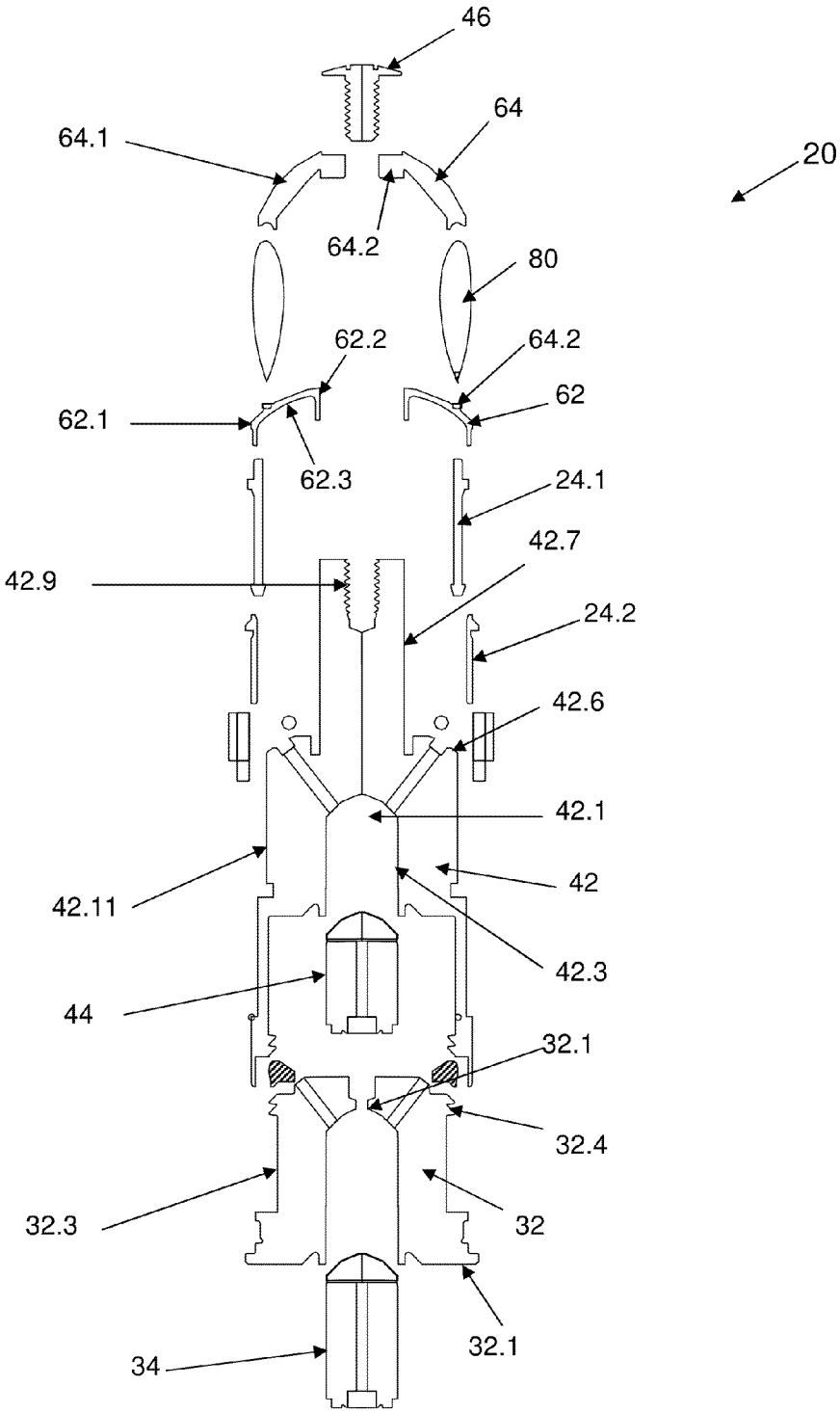
FIG. 1*b* is an exploded cross sectional view of the ammunition of FIG. 1*a*.
Figure 2:
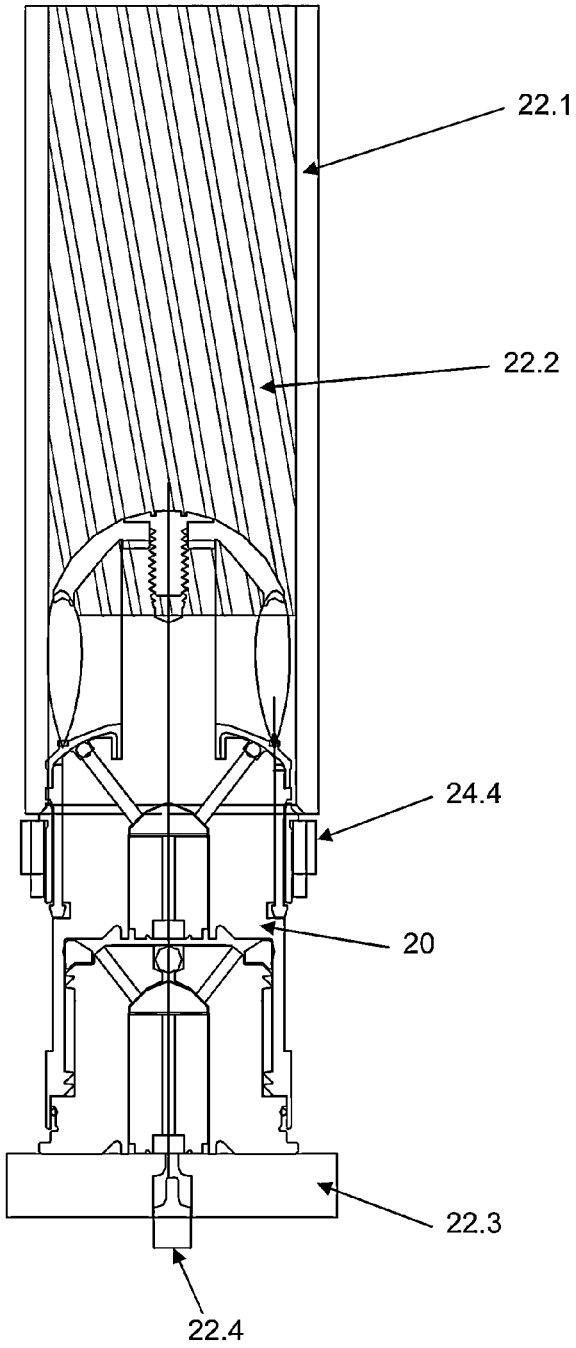
FIG. 2 illustrates a cross sectional view of the round of FIG. 1*a*, feeding into chamber of a gun.
Figure 3:
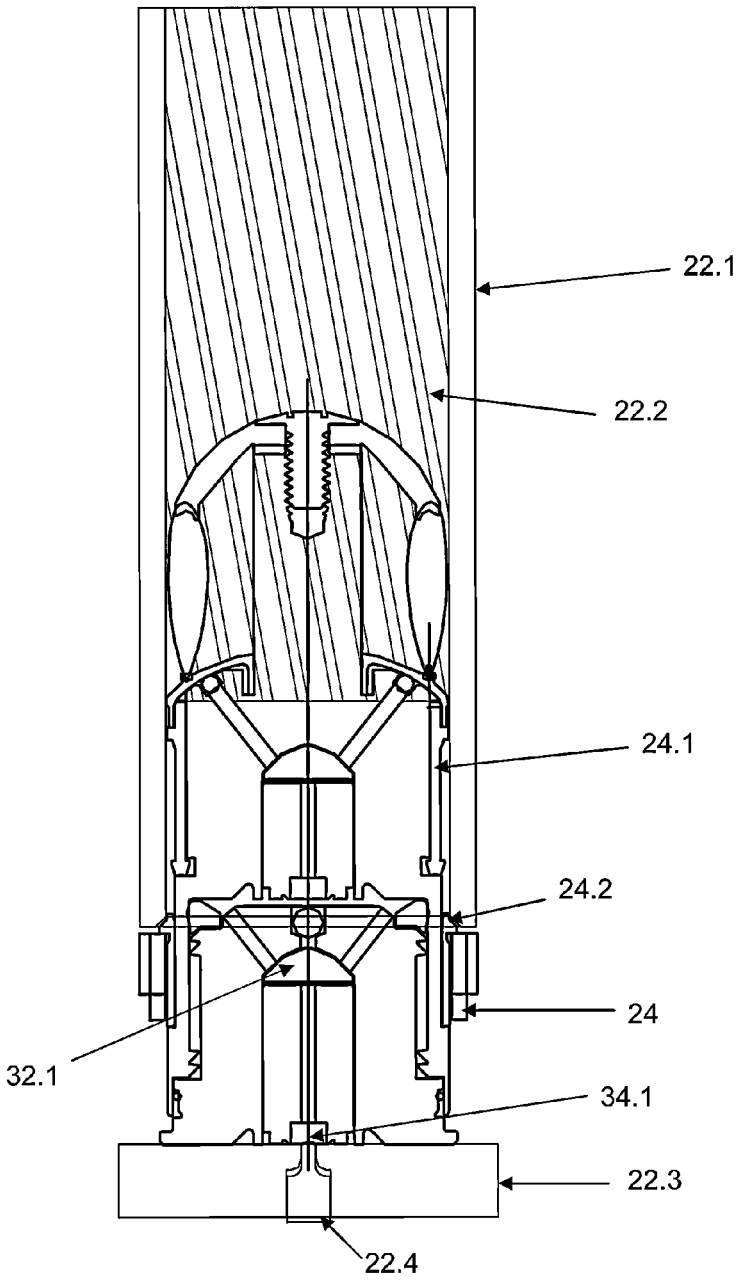
FIG. 3 illustrates a cross sectional view of the round of FIG. 1*a* chambered at the firing point in a gun barrel.
Figure 4:
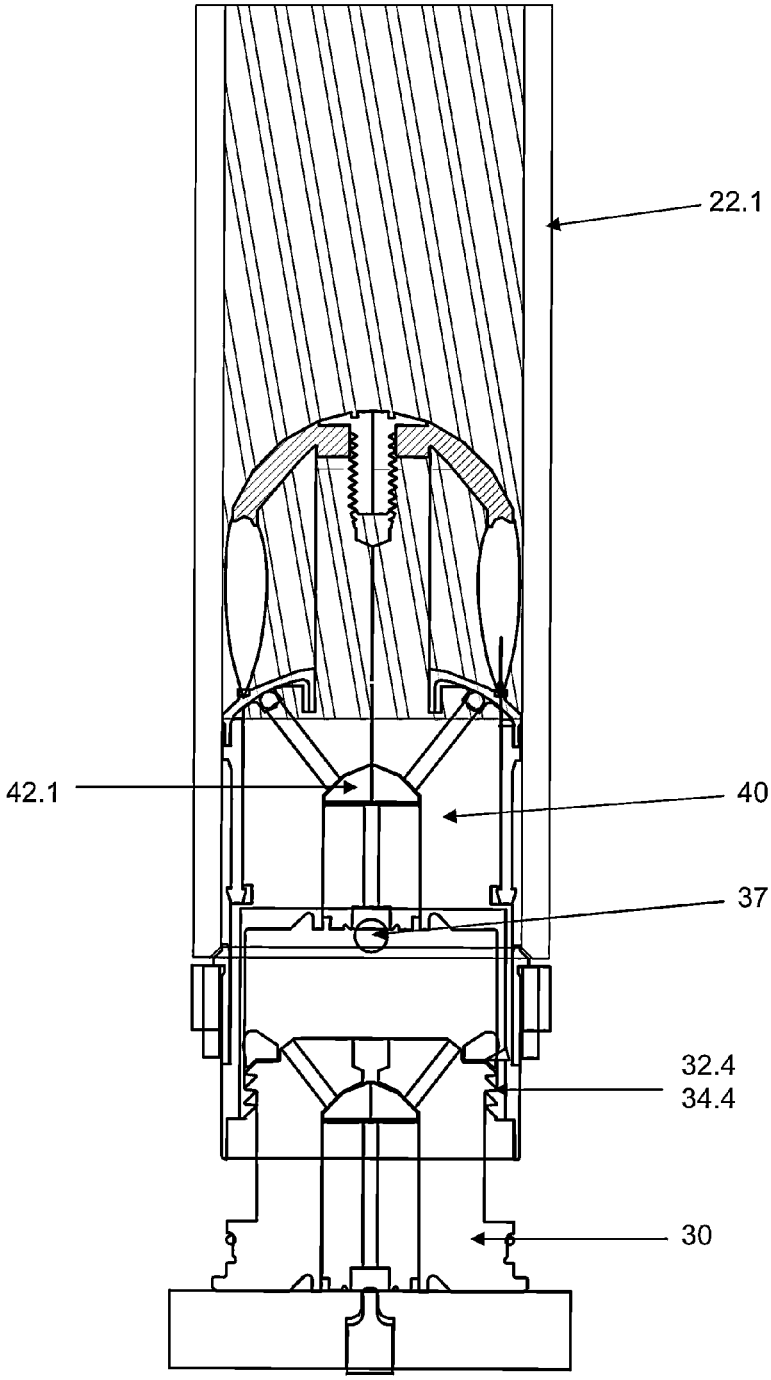
FIG. 4 illustrates a cross sectional view of the round of FIG. 1*a* as the round telescopes and fires the projectile.
Figure 5:
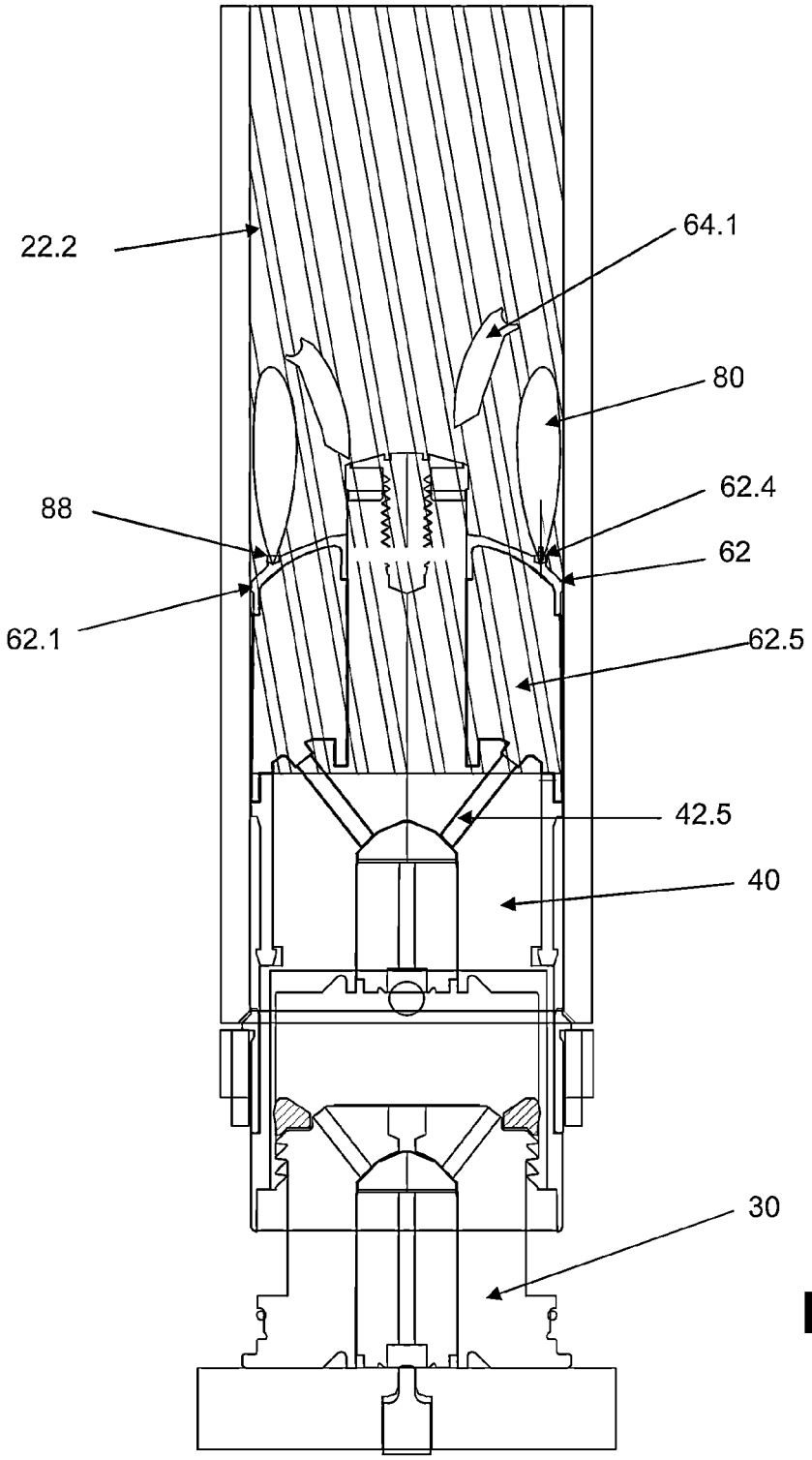
FIG. 5 illustrates a cross sectional view of the round of FIG. 1*a* as the projectile is launched in the barrel chamber.
Figure 6:
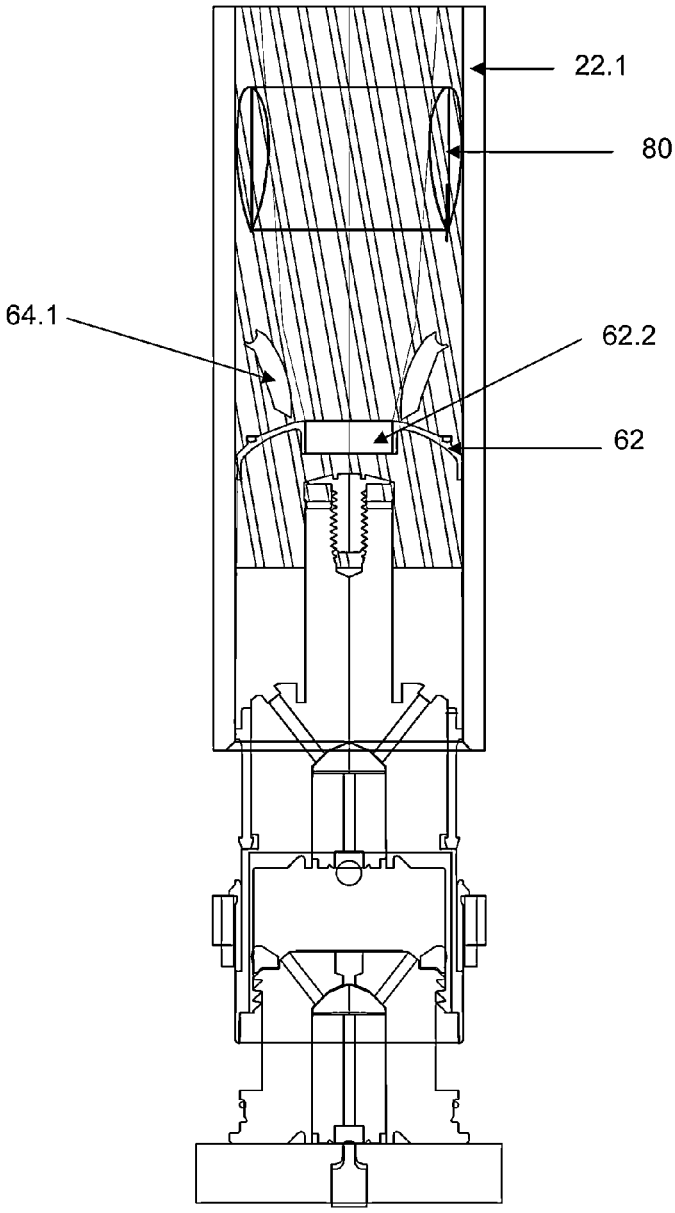
FIG. 6 illustrates a cross sectional view of the round of FIG. 1*a* as the projectile is released to travel down the gun bore and the round begins to eject.
Figure 7:
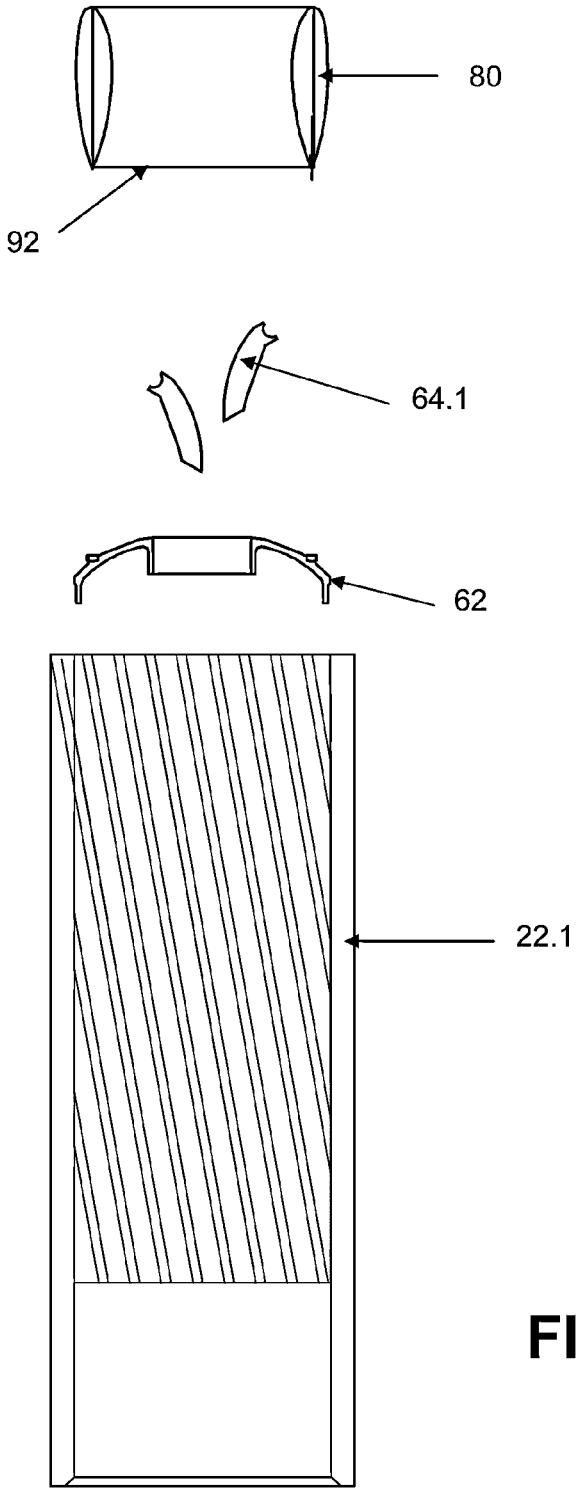
FIG. 7 illustrates a cross sectional view of the assembled ammunition round as the projectile, and F.O.D. and sabot exits the muzzle.

FIGS. 1*a* and 1*b* show cross-sectional and exploded views of a munition 20 according one embodiment of the present invention. Ammunition 20 includes a payload section 60 supported by a launch support assembly 40. Further, a telescoping assembly 30 co-acts with launch assembly 40 to provide a breech block resetting capability for automatic weapons. Ammunition 20 can be fired from any type of gun, including the Mk 19 machine gun, the Mk M203 and Milkor single shot weapons, as well as 37 mm guns.

Telescoping assembly 30 includes a support member 32 that is slidingly received within a pocket of launch support member 42. Telescoping support further includes a pocket 32.3 that receives within it an explosive assembly 34. In one embodiment, explosive assembly 34 includes an initiator 34.1 in fluid communication via a passageway 34.3 within packing 34.2 to an explosive charge 34.4. A resilient seal 36 provides sealing of the exploded charge 34.4 between members 32 and 34 prior to the rearward telescoping of member 32 relative to member 34. Circumferential abutment 32.4 interacts with abutment 42.4 to limit the sliding of member 32 relative to member 42. In some embodiments, telescoping assembly 30 further includes a ball-shaped firing pin 37 that is launched into and thereby causes ignition of initiator 44.1 during firing of ammunition 20. Telescoping assembly 30 is preferably present in those versions of ammunition 20 that are fired from automatic weapons. Some embodiments of the present invention pertain to single shot weapons that do not need the function provided by telescoping assembly 30.

Launch support assembly 40 provides secure mechanical coupling to the firing chamber of a gun, supports payload section 60, slidingly couples to assembly 30 as previously described, and further supports a linkage assembly 24. Linkage assembly 24, as shown in FIGS. 1*a* and 1*b*, is a sliding link assembly that couples adjacent ammunitions 20 to each other. Linkage assembly includes a seal and retaining member 24.1 that is received on the outer diameter 42.11 of support 42. A link mount 24.2 is slidingly received over the outer diameter of retainer 24.1. A first Link 24.3 is tightly secured to the outer diameter of link mount 24.2, and further receives and retains a captured coupling link 24.4 that couples to another coupling link of an adjacent ammunition 20. Operation of the links, as well as operation of a munition, will be shown in FIGS. 29-34 that follow.

Support member 42 of Launch support assembly 40 further includes within it a pocket 42.3 that receives an explosive assembly 44. Explosive assembly includes an initiator 44.1 that is in fluid communication with an explosive charge 44.4 by way of a central passage 44.3 within packing material 44.2.

Explosive charge 44.4 is placed within a combustion chamber 42.1 of support 42. A plurality of gas release passages 42.5 provide fluid communication of the combusted explosive charge with a plurality of hemispherical balls at the exit of the passage.

In some embodiments, one or both of the combustion chambers 32.1 or 42.1 can include a rupture diaphragm such as a copper disc that is conformally placed between the explosive charge and the chamber defined by corresponding member 32 or 42. This disc contains the explosive gases until they reach sufficient pressure to rupture the disc wall and subsequently release the combusted gases into the corresponding gas passages 32.5 or 42.5.

Extending from one end of support 42 is a rod 42.7 that includes a receptacle for a fastener, such as threaded receptacle 42.9. Support 42 further includes a circumferentially extending shoulder 42.6 located proximate to the end of gas release passages 42.5. A pocket is formed around the base of rod 42.7 between the outer diameter 42.8 of the rod and the inside of shoulder 42.6.

A payload section 60 is received on rod 42.7 and shoulder 42.6 of support member 42. Payload section 60 includes a sabot that is fittingly received on shoulder 42.6. A frangible retainer 64 is received on the distal end of rod 42.7. A ringed airfoil projectile 80 is captured between sabot 62 and retainer 64.

Sabot 62 includes a curving annular middle section located between an inner cylindrical portion 62.2 and an outer cylindrical portion 62.1. The inner face of the annular midsection is received against shoulder 42.6. The inner diameter of cylindrical section 62.2 is in sliding contact with outer diameter 42.8 of rod 42.7. The outer diameter of outer cylindrical portion 62.1 includes an outer most diameter that is in sliding contact with the inner diameter and rifling 22.2 of the barrel 22.1 of a gun 22, as will be shown and described for FIGS. 29-34. Sabot 62 further includes a plurality of circumferentially extending drive features 62.4 that couple to corresponding and complementary driven features of ring airfoil 80.

Retainer 64 includes a center support ring 64.2 that is held on the end of rod 42.7 by a fastener or other coupling means 46. A plurality of outwardly extending and separated petals 64.1 extend from support ring 64.2 a frangible feature such as a notch is preferably located at the connection of a petal to the support ring, and acts as a stress riser during operation. Each petal extends outwardly and aft (aft being defined as the direction toward telescoping assembly 30 and forward being defined as the direction toward payload section 60 and further toward the open end of the gun barrel), and on the aft face of each petal there is a small pocket for receiving within it the leading edge 90 of ring air foil 80. Ring air foil 80 is captured on ammunition 20 between sabot 62 and retainer 64.

Figure 8:
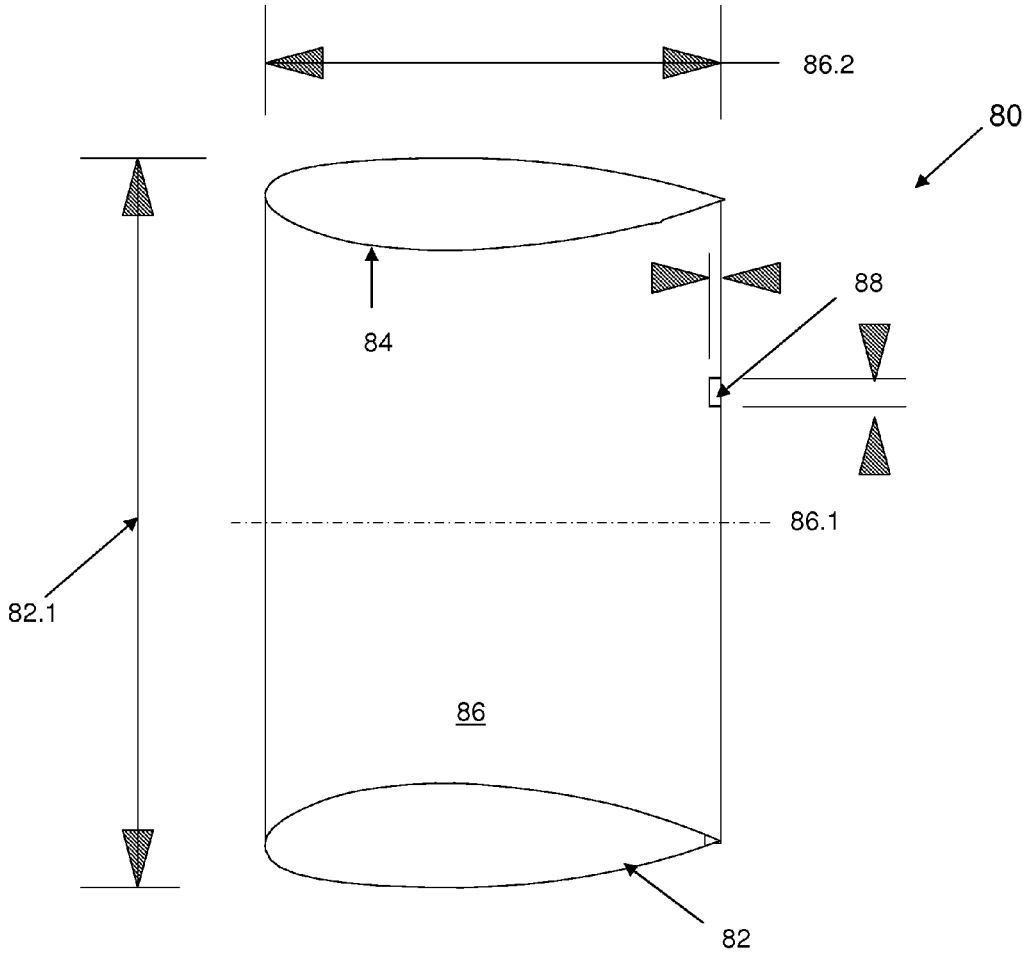
FIG. 8 illustrates a cross sectional view of a ring airfoil projectile according to one embodiment of the present invention.

FIG. 8 shows cross sectional, side elevational view of ring airfoil 80. Airfoil 80 comprises a substantially hollow, annular ring wall. The wall of airfoil 80 has an airfoil section 94 that includes a cambered outer surface 82 and cambered inner surface 84. These inner and outer surfaces 82 and 84, respectively, meet at a substantially blunt leading edge 90, and at a substantially tapered trailing edge 92. The inner surface 84 of airfoil 80 defines a substantially open central aperture 86. Preferably, ring airfoil 80 is a body of revolution formed by rotating airfoil section 94 about central axis 86.1. Ring airfoil 80 has a length 86.2 from leading edge 90 to trailing edge 92, and an outer diameter 82.1 extending across the outermost portion of outer surface 82, and an innermost diameter or throat 86.4 extending across the innermost portion of inner surface 84. In some embodiments, trailing edge 92 includes a plurality of drive features (such as rectangular cutouts) that mate with complementary features on sabot 62.

Tables 1 and 2 present data for outer diameter and inner diameter, respectively, related to a programming table of values for a computer numerically controlled machine to fabricate a projectile according to one embodiment of the present invention. In both of these tables, the first column represents the diametrical distance (or twice the radius from the center line), and the second column represents a location along the Z Axis. A representative projectile can be machined from this data. If a cutting tool having a radius of about 0.016 is positioned in accordance with this data, it will have a tangent point of contact on the airfoil surface. In one embodiment, the overall length of the projectile is about 1 inch.

TABLE 1

| Diametral Distance | Axial Location |
|---|---|
| 1.4364 | +.0158 |
| 1.4422 | +.0153 |
| 1.4476 | +.0148 |
| 1.4530 | +.0140 |
| 1.4586 | +.0131 |
| 1.4644 | +.0119 |
| 1.4708 | +.0104 |
| 1.4774 | +.0088 |
| 1.4842 | +.0066 |
| 1.4908 | +.0045 |
| 1.4968 | +.0022 |
| 1.5032 | −.0004 |
| 1.5086 | −.0029 |
| 1.5136 | −.0055 |
| 1.5188 | −.0064 |
| 1.5236 | −.0113 |
| 1.5280 | −.0145 |
| 1.5324 | −.0179 |
| 1.5366 | −.0215 |
| 1.5410 | −.0255 |
| 1.5452 | −.0298 |
| 1.5492 | −.0344 |
| 1.5532 | −.0393 |
| 1.5572 | −.0445 |
| 1.5812 | −.0502 |
| 1.5850 | −.0582 |
| 1.5888 | −.0627 |
| 1.5726 | −.0697 |
| 1.5762 | −.0771 |
| 1.5798 | −.0850 |
| 1.5834 | −.0934 |
| 1.5868 | −.1024 |
| 1.5902 | −.1125 |
| 1.5936 | −.1230 |
| 1.5968 | −.1340 |
| 1.5996 | −.1457 |
| 1.6028 | −.1582 |
| 1.6056 | −.1713 |
| 1.6064 | −.1755 |
| 1.6090 | −.1898 |

TABLE 1-continued

| Diametral Distance | Axial Location |
|---|---|
| 1.6116 | −.2048 |
| 1.6138 | −.2207 |
| 1.6180 | −.2375 |
| 1.6176 | −.2519 |
| 1.6194 | −.2705 |
| 1.6210 | −.2901 |
| 1.6222 | −.3109 |
| 1.6234 | −.3329 |
| 1.6238 | −.3420 |
| 1.6246 | −.3888 |
| 1.6252 | −.3907 |
| 1.6252 | −.4127 |
| 1.6252 | −.4346 |
| 1.6246 | −.4523 |
| 1.6240 | −.4888 |
| 1.6228 | −.4854 |
| 1.6218 | −.4987 |
| 1.6200 | −.5181 |
| 1.6178 | −.5373 |
| 1.6156 | −.5558 |
| 1.6134 | −.5715 |
| 1.6108 | −.5886 |
| 1.6076 | −.6057 |
| 1.6042 | −.6229 |
| 1.5998 | −.6434 |
| 1.5956 | −.6612 |
| 1.5912 | −.6789 |
| 1.5912 | −.6789 |
| 1.5864 | −.6985 |
| 1.5812 | −.7143 |
| 1.5758 | −.7315 |
| 1.5704 | −.7484 |
| 1.5644 | −.7652 |
| 1.5574 | −.7843 |
| 1.5508 | −.8010 |
| 1.5440 | −.8180 |
| 1.5366 | −.8363 |
| 1.5288 | −.8532 |
| 1.5210 | −.8694 |
| 1.5138 | −.8847 |
| 1.5080 | −.8995 |
| 1.4982 | −.9143 |
| 1.4944 | −.9213 |
| 1.4882 | −.9362 |
| 1.4782 | −.9534 |
| 1.4648 | −.9724 |
| 1.4554 | −.9881 |
| 1.4463 | −.1.0028 (off surface for reference of shape only$^{+1}_{-.0)}$ |
| 1.4394 | −.1.10136 (off surface for reference of shape only) |

TABLE 2

| Diametral Distance | Axial Location |
|---|---|
| 1.4284 | +.0158 |
| 1.4148 | +.0146 |
| 1.3994 | +.0125 |
| 1.3842 | +.0091 |
| 1.3710 | +.0051 |
| 1.3688 | +.0002 |
| 1.3470 | −.0054 |
| 1.3416 | −.0083 |
| 1.3294 | −.0157 |
| 1.3156 | −.0253 |
| 1.3054 | −.0332 |
| 1.2932 | −.0437 |
| 1.2878 | −.0492 |
| 1.2708 | −.0868 |
| 1.2544 | −.0859 |
| 1.2392 | −.1054 |
| 1.2282 | −.1254 |

TABLE 2-continued

| Diametral Distance | Axial Location |
|---|---|
| 1.2142 | −.1458 |
| 1.2036 | −.1668 |
| 1.1946 | −.1878 |
| 1.1888 | −.2100 |
| 1.1808 | −.2323 |
| 1.1754 | −.2544 |
| 1.1710 | −.2780 |
| 1.1672 | −.2971 |
| 1.1640 | −.3178 |
| 1.1616 | −.3381 |
| 1.1588 | −.3771 |
| 1.1584 | −.3961 |
| 1.1588 | −.4155 |
| 1.1602 | −.4382 |
| 1.1622 | −.4583 |
| 1.1650 | −.4817 |
| 1.1688 | −.5085 |
| 1.1734 | −.5326 |
| 1.1788 | −.5601 |
| 1.1848 | −.5890 |
| 1.1918 | −.6182 |
| 1.1994 | −.6468 |
| 1.2076 | −.6747 |
| 1.2182 | −.7020 |
| 1.2258 | −.7285 |
| 1.2358 | −.7544 |
| 1.2464 | −.7796 |
| 1.2578 | −.8041 |
| 1.2698 | −.8284 |
| 1.2828 | −.8885 |
| 1.2988 | −.8776 |
| 1.3118 | −.9025 |
| 1.3278 | −.9277 |
| 1.3446 | −.9530 |
| 1.3824 | −.9788 |
| 1.3812 | |

Tables 3 and 4 present data for outer diameter and inner diameter, respectively, related to a programming table of values for a computer numerically controlled machine to fabricate a projectile according to another embodiment of the present invention. In both of these tables, the first column represents the diametrical distance (or twice the radius from the center line), and the second column represents a location along the Z Axis. A representative projectile can be machined from this data. If a cutting tool having a radius of about 0.016 is positioned in accordance with this data, it will have a tangent point of contact on the airfoil surface. In one embodiment, the overall length of the projectile is about 1 inch.

TABLE 3

| Diametral Distance | Axial Location |
|---|---|
| 1.4364 | +.0156 |
| 1.4422 | +.0153 |
| 1.4476 | +.0148 |
| 1.4530 | +.0140 |
| 1.4586 | +0131 |
| 1.466 | +0.119 |
| 1.4708 | +.0104 |
| 1.4774 | +.0086 |
| 1.4842 | +.0066 |
| 1.4908 | +.0045 |
| 1.4968 | +.0022 |
| 1.5032 | −.0004 |
| 1.5086 | −.0029 |
| 1.5138 | −.0055 |
| 1.5188 | −.0084 |
| 1.5236 | −.0113 |
| 1.5280 | −.0145 |
| 1.5324 | −.0179 |
| 1.5366 | −.0215 |

TABLE 3-continued

| Diametral Distance | Axial Location |
|---|---|
| 1.5410 | −0.255 |
| 1.5452 | −.0298 |
| 1.5492 | −.0344 |
| 1.5532 | −.0393 |
| 1.5572 | −.0445 |
| 1.5612 | −.0502 |
| 1.5650 | −.0682 |
| 1.5688 | −.0627 |
| 1.5726 | −.0697 |
| 1.5762 | −.0771 |
| 1.5798 | −.0850 |
| 1.5834 | −.0934 |
| 1.5868 | −.1024 |
| 1.5902 | −.1125 |
| 1.5936 | −.1230 |
| 1.5968 | −.1340 |
| 1.5998 | −.1457 |
| 1.6028 | −.1582 |
| 1.6056 | −.1713 |
| 1.6064 | −.1755 |
| 1.6090 | −.1898 |
| 1.6116 | −.2048 |
| 1.6138 | −.2207 |
| 1.6160 | −.2375 |
| 1.6176 | −.2519 |
| 1.6194 | −.2705 |
| 1.6210 | −.2901 |
| 1.6222 | −.3109 |
| 1.6234 | −.3329 |
| 1.6238 | −.3420 |
| 1.6246 | −.3666 |
| 1.6252 | −.3907 |
| 1.6252 | −.4127 |
| 1.6252 | −.4346 |
| 1.6246 | −.4523 |
| 1.6240 | −.4888 |
| 1.6228 | −.4854 |
| 1.6218 | −.4987 |
| 1.6200 | −.5181 |
| 1.6178 | −.5373 |
| 1.6156 | −.5556 |
| 1.6134 | −.5715 |
| 1.6106 | −.5886 |
| 1.6076 | −.6057 |
| 1.6042 | −.6229 |
| 1.5998 | −.6434 |
| 1.5956 | −.6612 |
| 1.5912 | −.6789 |
| 1.5864 | −.6965 |
| 1.5812 | −.7143 |
| 1.5758 | −.7315 |
| 1.5704 | −.7484 |
| 1.5644 | −.7652 |
| 1.5574 | −.7843 |
| 1.5508 | −.8010 |
| 1.5440 | −.8180 |
| 1.5366 | −.8353 |
| 1.5286 | −.8532 |
| 1.5210 | −.8694 |
| 1.5136 | −.8847 |
| 1.5060 | −.8995 |
| 1.4982 | −.9143 |
| 1.4944 | −.9213 |
| 1.4862 | −.9362 |
| 1.4762 | −.9534 |
| 1.4648 | −.9724 |
| 1.4554 | −.9881 |
| 1.4463 | −.1.0028 |
| 1.4394 | −.1.0136 |

TABLE 4

| Diametral Distance | Axial Location |
|---|---|
| 1.3918 | +.0156 |
| 1.3782 | +.0146 |
| 1.3628 | +.0125 |
| 1.3476 | +.0091 |
| 1.3344 | +.0051 |
| 1.3220 | +.0002 |
| 1.3104 | −.0054 |
| 1.3050 | −.0083 |
| 1.2928 | −.0157 |
| 1.2790 | −.0253 |
| 1.2688 | −.0332 |
| 1.2566 | −.0437 |
| 1.2510 | −.0492 |
| 1.2340 | −.0668 |
| 1.2178 | −.0859 |
| 1.2026 | −.1054 |
| 1.1896 | −.1254 |
| 1.1776 | −.1458 |
| 1.1580 | −.1878 |
| 1.1502 | −.2100 |
| 1.1440 | −.2323 |
| 1.1388 | −.2544 |
| 1.1344 | −.2760 |
| 1.1306 | −2971 |
| 1.1274 | −.3178 |
| 1.1250 | −.3381 |
| 1.1222 | −.3771 |
| 1.1218 | −.3961 |
| 1.1222 | −.4155 |
| 1.1236 | −.4362 |
| 1.1256 | −.4583 |
| 1.1284 | −.4817 |
| 1.1322 | −.5065 |
| 1.1368 | −.5326 |
| 1.1422 | −.5601 |
| 1.1482 | −.5890 |
| 1.1552 | −.6182 |
| 1.1628 | −.6468 |
| 1.1710 | −.6747 |
| 1.1796 | −.7020 |
| 1.1890 | −.7285 |
| 1.1990 | −.7544 |
| 1.2098 | −.7796 |
| 1.2210 | −.8041 |
| 1.2330 | −.8284 |
| 1.2462 | −.8685 |
| 1.2602 | −.8776 |
| 1.2752 | −.9025 |
| 1.2910 | −.9277 |
| 1.3080 | −.9530 |
| 1.3258 | −.9786 |
| 1.3446 | −1.007 |

The following is a description of the firing of ammunition as shown in FIGS. 2-7.

Upon being on the bolt face in the ready battery position, latched and ready to be fired, the trigger is pulled.

The bolt travels forward until the firing pin 22.4 is released, about 1" from the breech face 22.3.

The pin strikes the aft telescoping charges primer initiating the propellant; simultaneously an initiation ball 37 is propelled forward to a primer 34.1 for the forward payload propelling charge, and the expanding gas reacts against the telescoping piston to open the action and auto load function the gun.

The forward payload propelling charge expands against the sabot/pusher 62 pushing it forward while fracturing the projectile retainer 64 along one or more separation groove(s) on the central hub of the retainer releasing the sabot and projectile assembly for forward travel.

The sealing and rotating outer diameter 62.1 of sabot 62 seals the propelling gas from the action at the forcing cone of the chamber. The sabot/projectile assembly 160 is pushed along the bore and along the center guide mandrill 42.7, throughout the launch sequence.

The sabot/projectile assembly travels down the bore to the end of the guide mandrill having spin imparted to the assembly by the action of rifling 22.2 in the gun bore 22.1 rotating the sabot 62 which transfers the rotation by the action of drive dogs 62.4 on its forward face engaging slots 88 in the tail 92 of the ring airfoil projectile 80.

As the sabot leaves the mandrill the propelling gas are vented down the center of the sabot d own the bore ahead of the sabot/projectile assembly, protecting the ring airfoil projectile from disturbance by the gas, at which point the maximum velocity is achieved for both the sabot and projectile.

The sabot immediately begins to decelerate due to friction with the bore. This causes the projectile to separate, as it has little or no contact with the bore and little friction retarding its passage down the bore.

The projectile rides a turbulent boundary layer of air between its outer diameter and the bore guiding and centering it until it exits the muzzle. The sabot exits the muzzle at greatly reduced energy. The ring airfoil 80 is free to fly towards the target.

As the ring airfoil 80 travels through the air, if it is thought that a higher pressure is created in the duct 86 through it by the comparatively more cambered shaped of the airfoil surface on the inside of the duct in contrast to the lesser curved shape on the periphery of the ring airfoil creating a lower static pressure on the ring airfoil outer surface 82. This increased drag helps stabilize the projectile along with the gyroscopic spin imparted to it by action of the rifling, allowing the projectile to be less prone to curved flight paths and external disruptions such as cross wind and air disturbances. The center of pressure along the projectile longitudinal axis is aft or coincides with the center of mass. The action of the increased drag in the duct creates an aerodynamic stabilizing force on the projectile as if it has a tail much like an arrow, reducing the dependence on spin stabilization.

Figure 9:
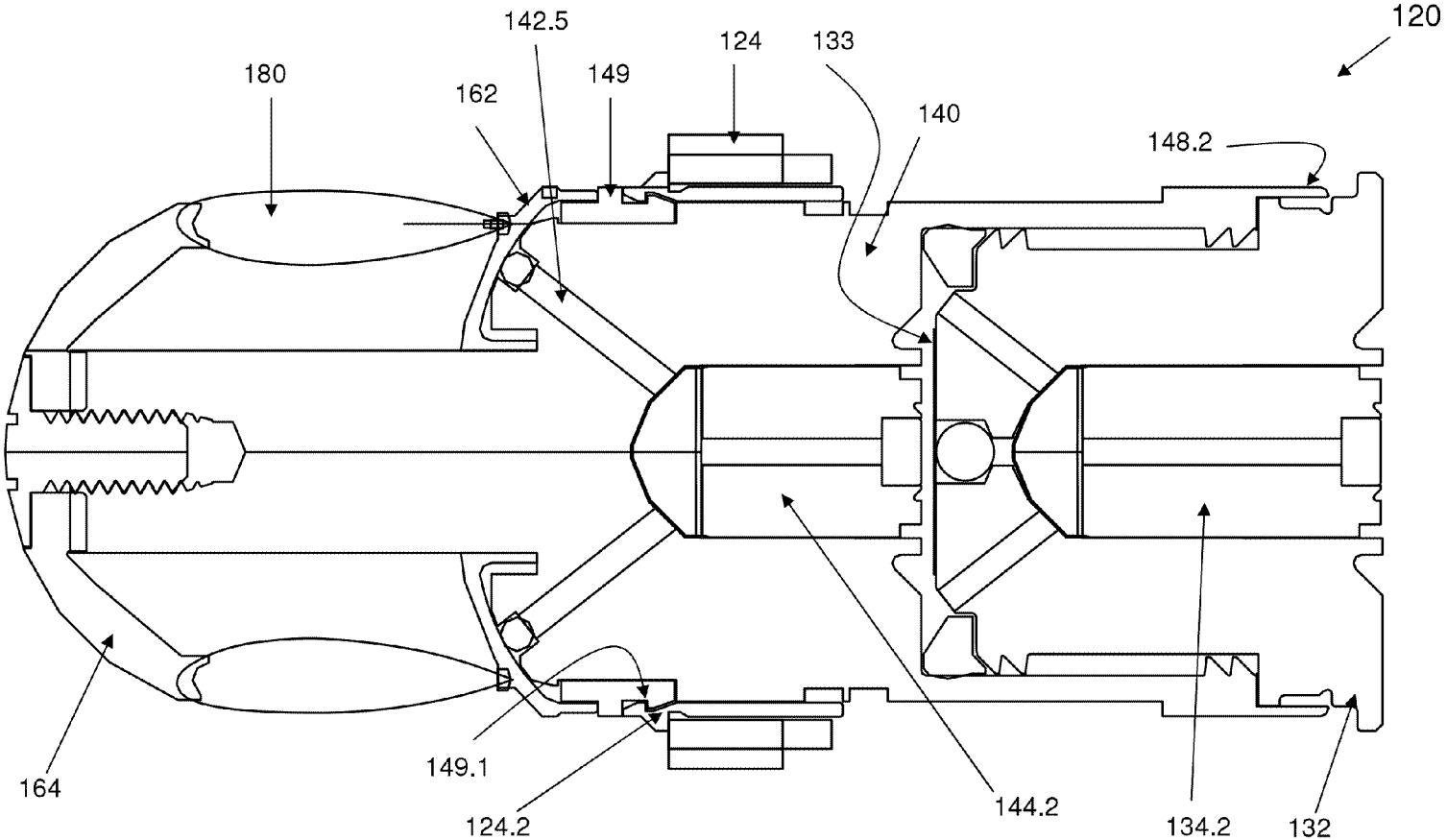
FIG. 9 illustrates an elevated cross sectional view of ammunition according to another embodiment of the present invention.

FIG. 9 illustrates a cross sectional view of an assembled ammunition round 120 having a forward hook for retaining the link mount 124 on the mandrill body 142 which is held in place on a shear shoulder 149.1 on a chamber seal 149. Round 120 includes a chamber seal 149 that is attached to support member 142. Preferably, seal 149 is fabricated from a plastic (such as ABS or aluminum) and is attached to body 142 with an interference fit. Chamber seal 149 includes an outwardly projecting sealing surface that forms a seal with the inner diameter barrel 22.1 so as to substantially obstruct the leakage of gas provided by gas release passages 142.5.

In some embodiments, munition 120 includes a crimped opening 148.2 that serves to frictionally couple together supports 132 and 142. Preferably, there are a plurality of discrete inward crimps 148.2 around the periphery of the aft end of body 142. These crimps capture support 142 within the large inner pocket of member 142, and prevent inadvertent telescoping of member 132 relative to member 142 during handling.

During firing, shoulder 149.1 of seal 149 is shorn when the bolt comes forward, forcing the link mount shoulder against the chamfer on the barrel breech. The shoulder on the link mount is milled flat to create clearance in the feed tray of the machine gun to prevent rubbing of the shoulder on the feed guide slots.

Figure 10:
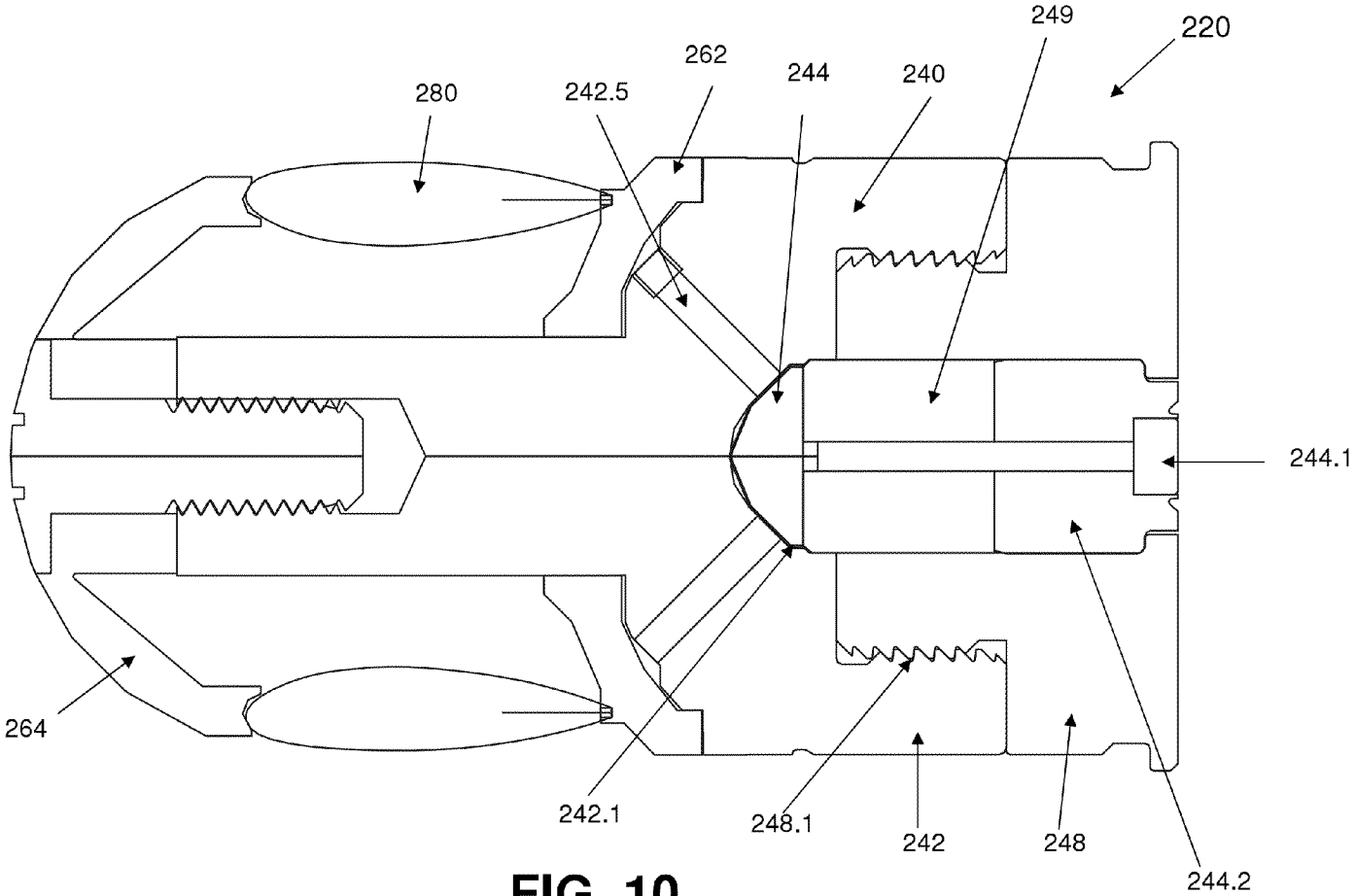
FIG. 10 illustrates an elevated cross sectional view of a round according to another embodiment of the present invention.

FIG. 10 illustrates a cross sectional view of an assembled ammunition round 220 in accordance with another embodiment. Round 220 includes a launch support assembly 240 that is threadingly engaged along interface 241.8 to a base 248. Assembly 240 includes a support 242 that includes at least a portion of a combustion chamber 242.1. Chamber 242.1 is generally shaped conically inward, and includes a plurality of gas passageways 242.5 that extend outwardly and into fluid communication with the underside of sabot 262.

In some embodiments, launch assembly 240 is fabricated, assembled, shipped, and stored as a subassembly. During final assembly of round 220, an explosive charge 244 is placed in combustion chamber 242.1. A mating base 248 is prepared as a subassembly including a chamber seal 249, primer holding 244.2, and primer 244.1. Subassemblies 240 and 248 are threadingly engaged to form a finished munition 220.

Round 220 is adapted and configured for use in standard single shot launchers like the M203. The forward mandrill 242 can be affixed with a fixed cartridge rim 248 used in place of the telescoping components. Threaded interface 248.1 includes male and female threads that can be reversed on the components to be attached if desired.

Figure 11:
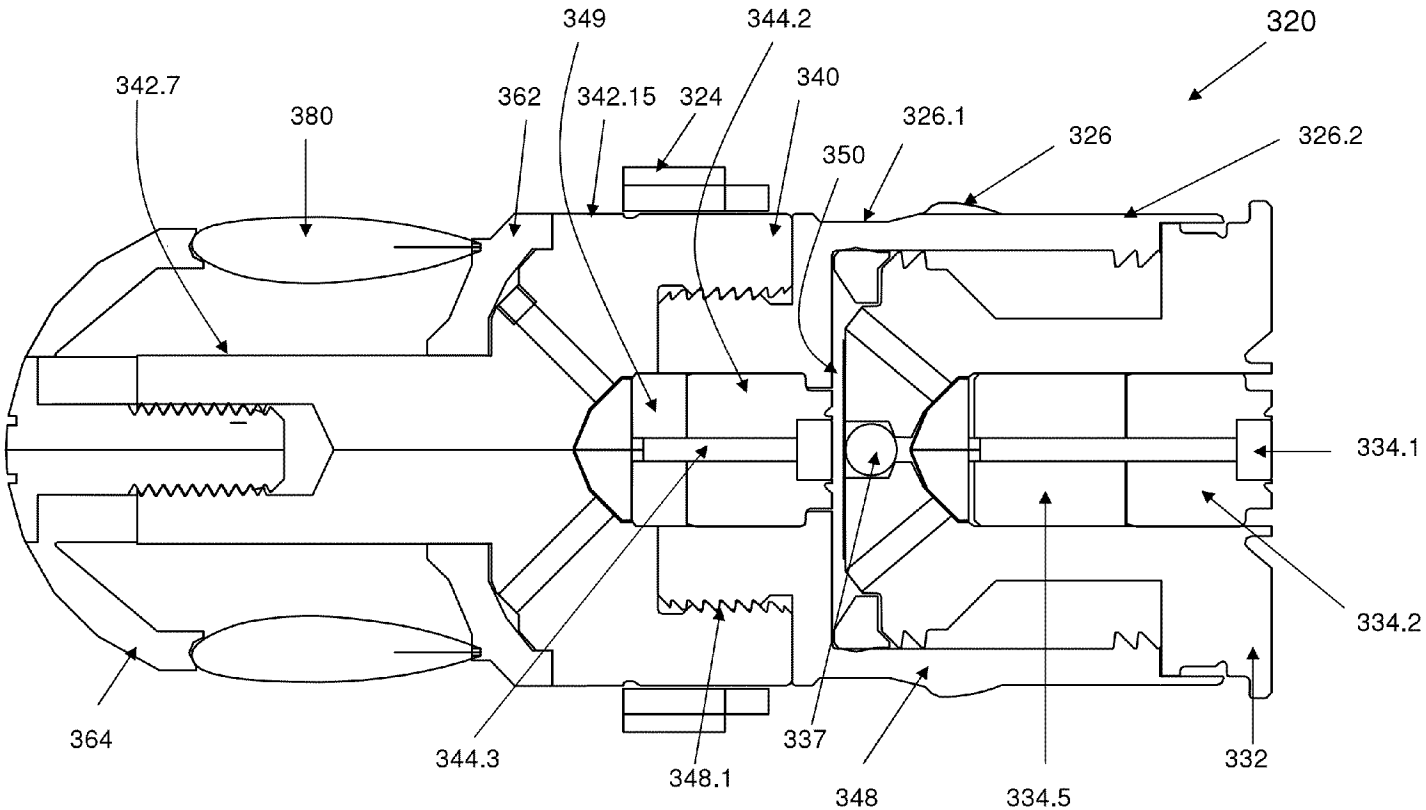
FIG. 11 is an elevated cross sectional view of a round according to another embodiment of the present invention.

The embodiment shown in FIG. 11 illustrates a cross sectional view of an assembled ammunition round 320 as another embodiment, Round 320 includes a launch support assembly 340 that is substantially the same as assembly 240. However, round 320 includes a base assembly 348 adapted and configured for use in semi-automatic and automatic guns. Base 348 includes male threads for threadably coupling to the female threads of assembly 340 at threaded interface 348.1.

Base 348, when fully assembled, further includes a chamber seal 349 and packing 344.2 located within a central pocket. The assembled base 348 further includes an initiator 344.1 that provides ignition through central passage 344.3 to explosive charge 344.4 after being impacted by ball 337. Ball 337 is retained within a pocket of support assembly 332. A cover plate 350 is adhered to a face of support 332 to retain ball 337 in its pocket. In one embodiment, cover plate 350 comprises an aluminum diaphragm of about 0.006 inches thickness.

FIG. 11 includes a linkage assembly 324 and linkage interfaces that are different than those described for round 20. Referring to FIG. 11, and also to FIGS. 13*c*, 16*a*, 16*b*, 16*g*, and 16*h*, which have related linkage features, body (or base) 348 includes a region 326.1 of reduced outer diameter immediately in front of a region 326 of increased outer diameter. Behind ridge 326 is an area 326.2 of constant diameter that is preferably about midway between diameters 326.1 and 326. Preferably, diameter 326.2 is about the same as diameter 342.15 of support 342.

Linkage assembly 324 is preferably spring loaded in tension around outer diameter 342.15 of body 342. The spring tension of link 324 is chosen to securely locate linkage 324 on body 342 during pre-firing handling. In one embodiment, linkage 324 comprises two sheet metal stampings that overlap at the top and bottom (as shown in FIG. 11), and further which are spot welded together in the overlapping area 324.9.

During firing, the movement by the breech block 22.3 of the gun 22 places round 320 into the firing chamber. Contact between the end of barrel 22.1 and the front face of linkage 324 forces link 324 to slide aft toward depression 326.1. Since linkage 324 is placed in tension, this movement into an area of reduced diameter (relative to diameter 342.15) momentarily reduces the amount of tension. As the coaction of the end of the barrel and linkage 324 continues, link 324 is forced to pivot open toward the rear, and climb over ridge 326. Preferably, the aft face of depression 326.1 and the forward face of ridge 326 are sloped to minimize gouging. As the backward action of link 324 continues, it climbs over ridge 326 and relocates on diameter 326.2.

Regions of body 348 that contact linkage 324 are generally cylindrical and can include one or more milled flats to provide adequate clearance to parts of the gun and ammunition feed tray. Further, although generally cylindrical regions are shown and described, various embodiments of the present invention contemplate other types of surface features (including a plurality of circumferentially-space projections) that support the underside of linkage 324 as described herein as linkage 324 slides aftward over body 348.

Round 320 includes a separate telescoping chamber (or base) 348 and mandrill body 332 to allow interchangeability with single shot rounds. The telescoping components needed for autoloading in a machine gun are separate from ring airfoil components. The buttress shoulder on the body of the round which is used to react against the barrel breech chamfer is milled flat to clear the feed tray of the gun and provide free clearance to the link as it is slide back by action of the bolt.

Figure 12:
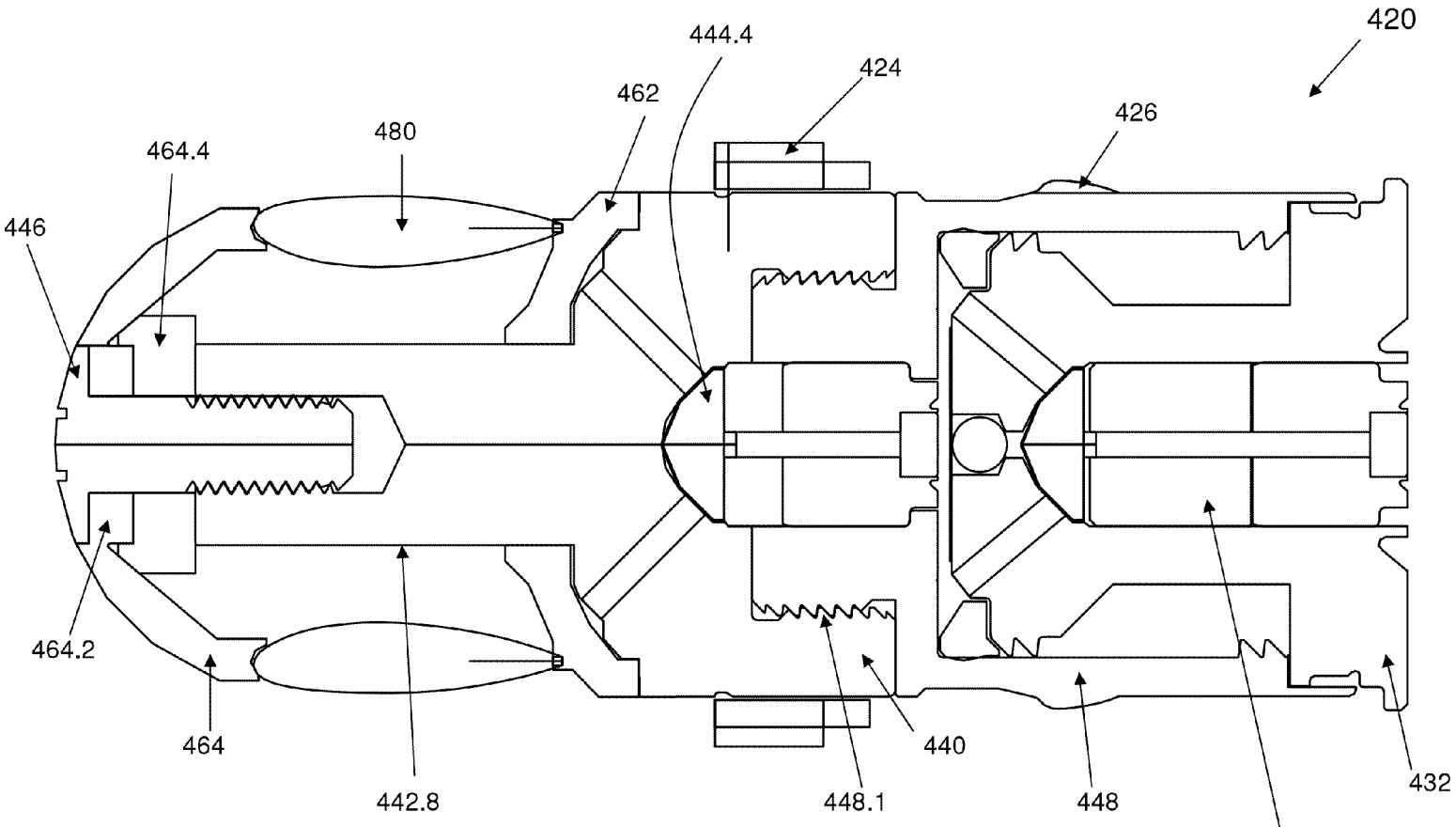
FIG. 12 is an elevated cross sectional view of a round according to another embodiment of the present invention.

The embodiment shown in FIG. 12 illustrates a cross sectional view of an assembled ammunition round 420 as another embodiment. Round 420 includes means 464.4 for stopping sabot 462. As shown in FIG. 12, stopping means 464.4 includes an oversize washer mounted inbetween support ring 464.2 of retainer 464 and rod 442.7 of support member 442. During firing of munition 420, sabot 462 is pushed forward by combustion gases and is guided by both the inner diameter of barrel 22.1 and the outer diameter 442.8 of rod 442.7. This guided, forward travel of sabot 462 pushes projectile 480 into the frangible retaining petals of retainer 464. These petals break, and sabot 462 continues pushing projectile 480 toward the exit of the barrel. The sliding motion of sabot 462 stops when its forward face contacts the aft face of sabot stop 464.4. After contact is made, projectile 480 continues forward and is ejected from the gun barrel. Sabot 462 is retained on rod 442.7. Sabot stop 464.4 stops the sabot 462 from exiting the muzzle, and prevents the sabot from being a secondary projectile for both unwanted target impacts and to prevent distraction of the gunner's sighting ability by the sabot.

Figure 13A:
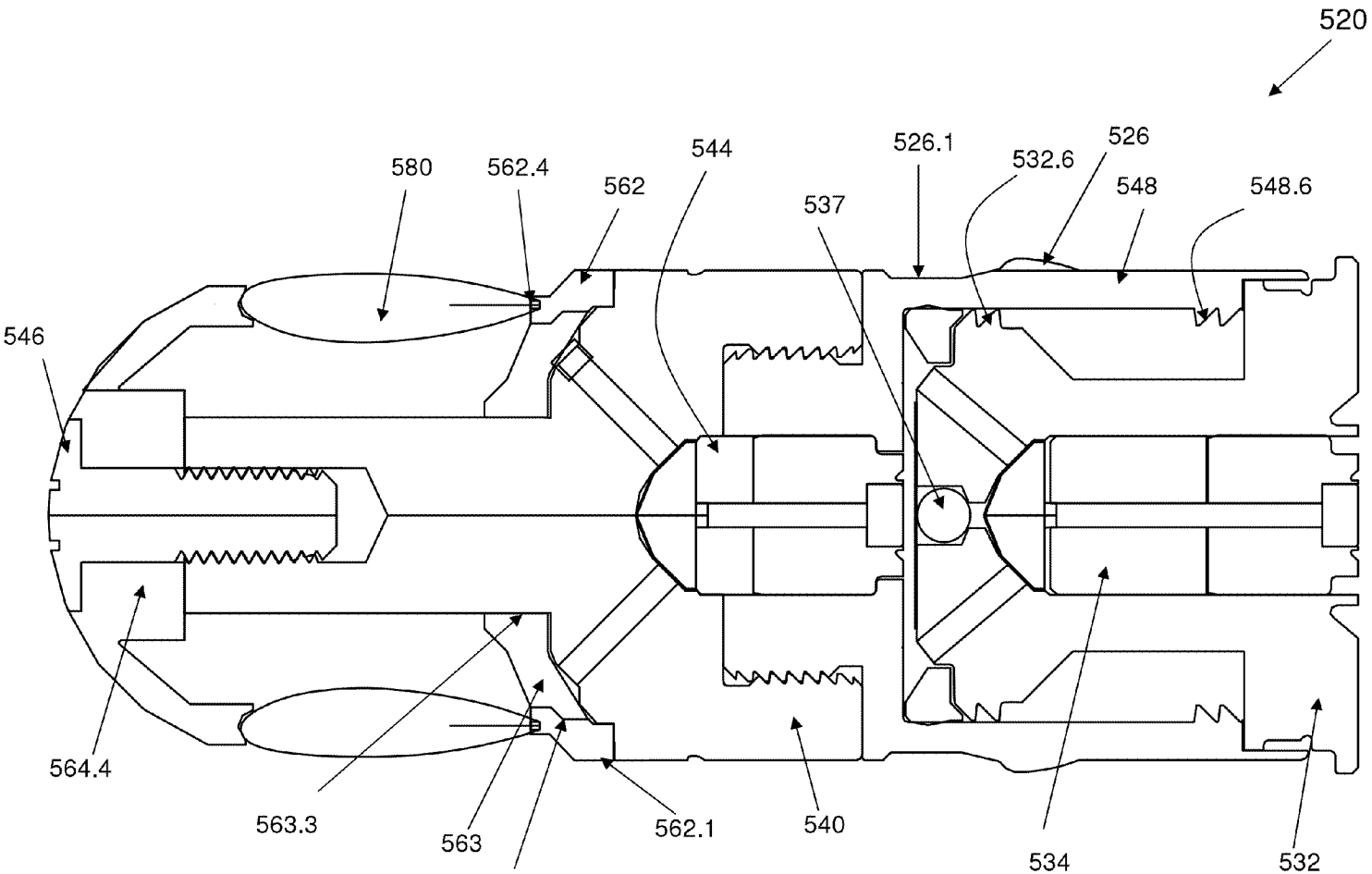
FIG. 13*a* is an elevated cross sectional view of a round according to another embodiment of the present invention.
Figure 13B:
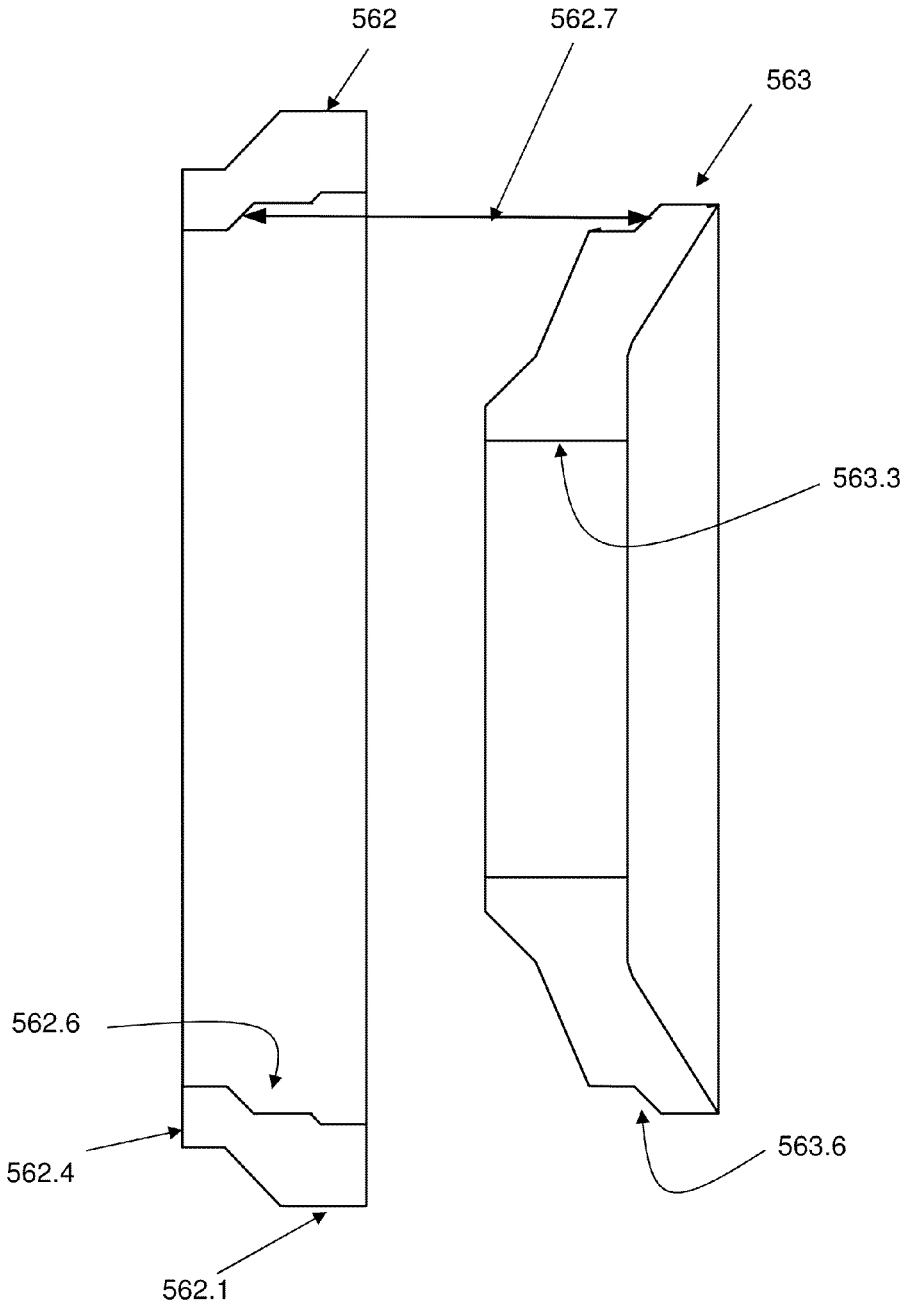
FIG. 13*b* is a cross sectional representation of the sabots of FIG. 13*a* after separation.
Figure 13C:
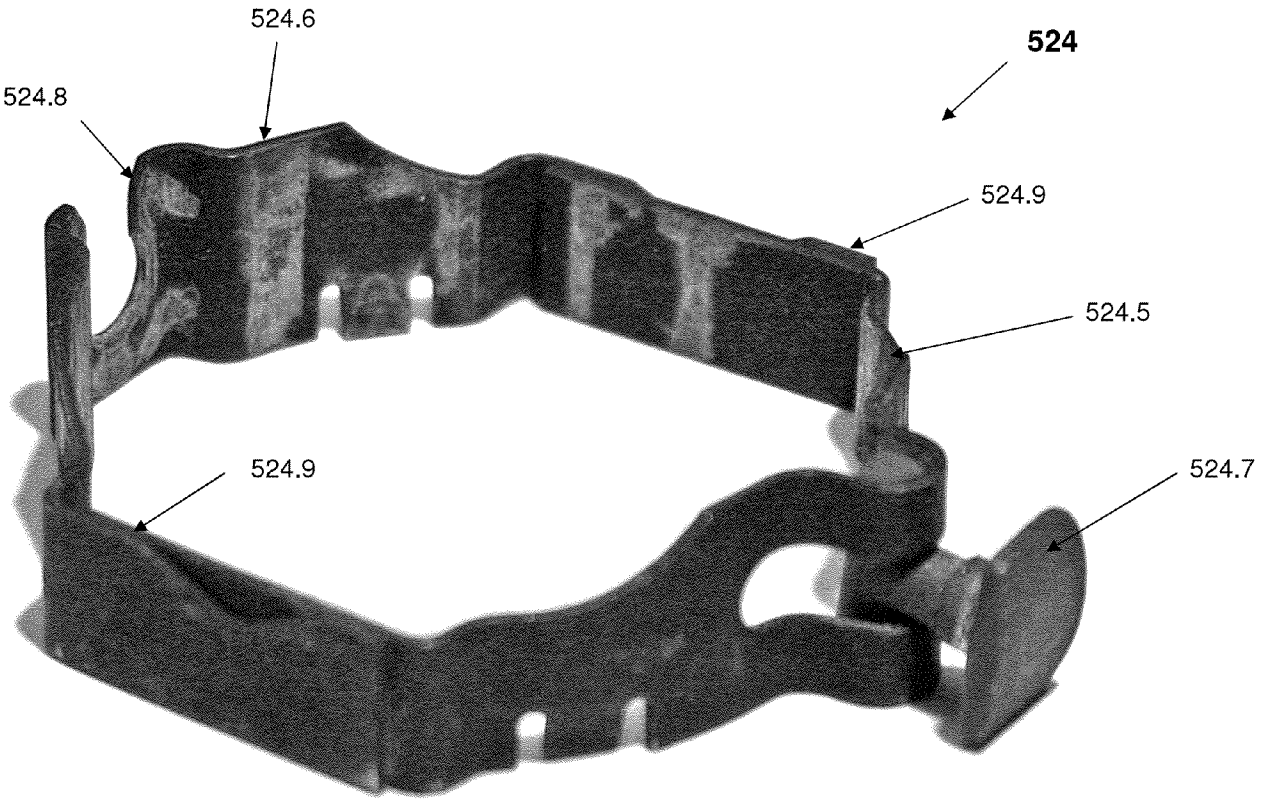
FIG. 13*c* is a perspective photographic representation of the linkage assembly for the round of FIG. 13*a*.

FIGS. 13*a*, 13*b*, and 13*c* illustrate views of an assembled ammunition round 520. Round 520 is the same as round 420, except that a separate sabot stop 464.4 is replaced with a stop 564.4 that is molded integrally with retainer 564.

Yet another feature of round 520 is the incorporation of a two piece sabot. A first, outer sabot 562 includes an outer diameter 562.1 that is in sealing contact with the inner diameter of the gun barrel to discourage leakage of combustion gas. Further, outer diameter 562.1 engages the rifling of the barrel and thereby impart spin to outer sabot 562. Outer sabot 562 includes a plurality of driving features (dogs) 562.4 that engage the trailing end of projectile 580, to thereby also imparts spin to projectile 580. Yet other embodiments contemplate that either the inner sabot or outer sabot can include the drive dogs that engage the trailing edge of the projectile.

As best seen in FIG. 13*b*, round 520 further includes an inner sabot 563 having an inner diameter 563.3 that is guided along the outer diameter of rod 542.7. The outermost diameter of inner sabot 563 is adapted and configured with driving and sealing features 563.6 that interlock with corresponding features 562.6 of inner sabot 562. As indicated by arrows 562.7, the driving features preferably include contacting surfaces adapted and configured to transmit a force that has at least one vector component parallel to the axis of the gun barrel for transmitting propulsive load to the projectile. However, yet other embodiments of the present invention contemplate means for driving that include frictional, interference-type fits between the inner and outer sabots.

FIG. 13*c* depicts one embodiment of the linkage assembly 524 of munition 520. Linkage assembly 524 includes a first formed, sheet metal link 524.5 coupled to a second, formed, sheet metal link 524.6 by a plurality of spotwelds along upper and lower linkage overlapping portions 524.9. Link assembly 524 further includes a T-pin 524.7 that is captured on a lateral side of link 524.5. T-pin 524.7 is adapted and configured to couple within the slot 524.8 of linkage piece 524.6. T-pin 524.7 and slot 524.8 are examples of complementary-shaped features for coupling to adjacent munitions in a linked belt.

Figure 14:
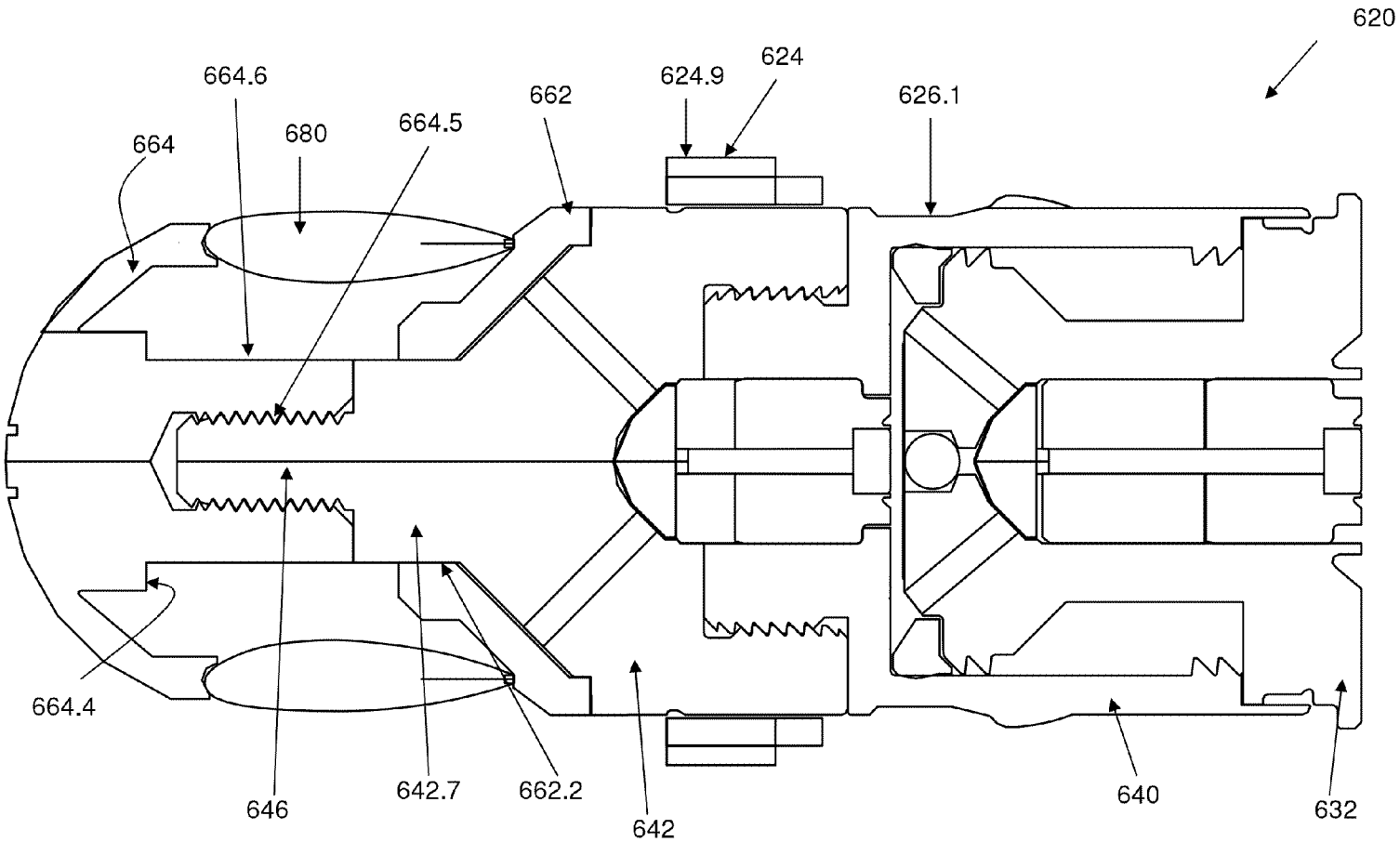
FIG. 14 is an elevated cross sectional view of a round according to another embodiment of the present invention.

FIG. 14 illustrates a cross sectional view of the assembled ammunition round 620, another embodiment of the present invention. Round 620 includes a retainer 664 including a central rod 664.6 that threadably couples to threads 646 of support 642. In one embodiment, retainer 664 further includes a sabot stop 664.4 for stopping the forward motion of sabot 662. In some embodiments, the inner diameter 662.2 of sabot 662 is guided by the substantially aligned and parallel outer diameters of rod 642.7 and rod 664.6. The present invention contemplates the fastening of a retainer 664 to a support 642 in which either component has male threads, and the other component has female threads. Further, other embodiments contemplate alternate means of fastening retainer 664 to support 642, including the use of adhesives, and further the use of one-way interlocking features, such as the ratchet and lock features of some types of rivets. In the latter case, retainer 664 would be pressed onto rod 642.7 in a non-releasable manner.

Figure 15:
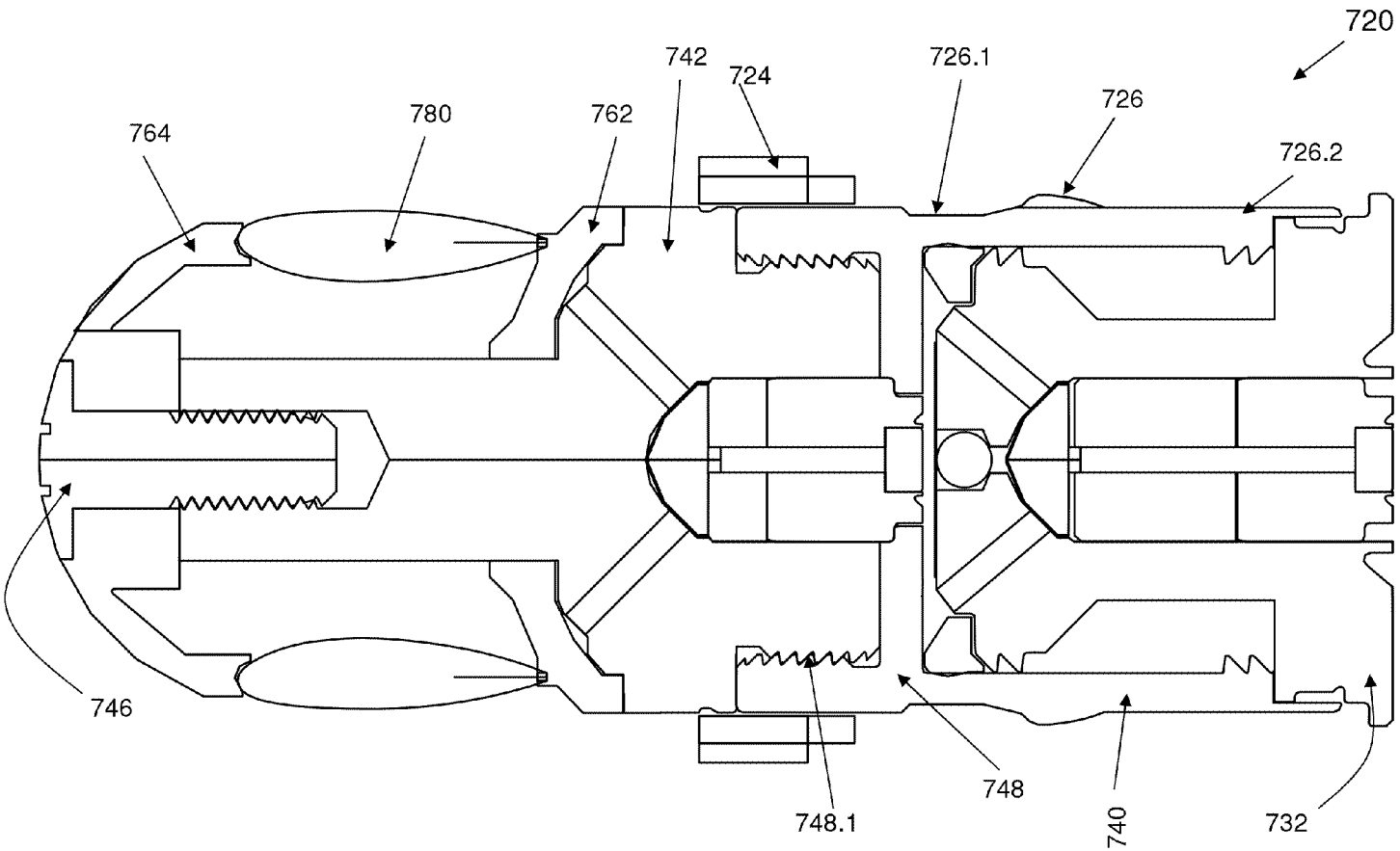
FIG. 15 is an elevated cross sectional view of a round according to another embodiment of the present invention.

FIG. 15 illustrates a cross sectional view of an assembled ammunition round 720 as another embodiment. Round 720 includes a threaded interface 748.1 between body 742 and outer support assembly (base) 748 in which support member 742 includes the male interface and base 748 includes the female interface. Yet other embodiments contemplate other means for coupling body 742 to base 748, including the use of adhesives, and further the use of a one-way interlocking interface such as an internal ratchet and lock of a rivet. Other coupling ideas include an interference fit between body 742 and 748.

FIGS. 16*a*, 16*b*, 16*c*, 16*d*, 16*e*, 16*f*, 16*g*, and 16*h* depict an ammunition round 820 according to another embodiment of the present invention. Round 820 includes a base 848 having a central projection 848.13 that is accepted within a compartment (or pocket) 842.13 within support body 842. Projection 848.13 further includes a central passage 844.3 for communicating an ignition pulse from the primer to the explosive charge 844.4. In one embodiment an o-ring seal 842.14 resides within a groove of pocket 842.13 for sealing of combustion gases. Base 848 includes female threads 848.6 that interface with male threads on base 842 (this thread orientation being interchangeable).

Figure 16A:
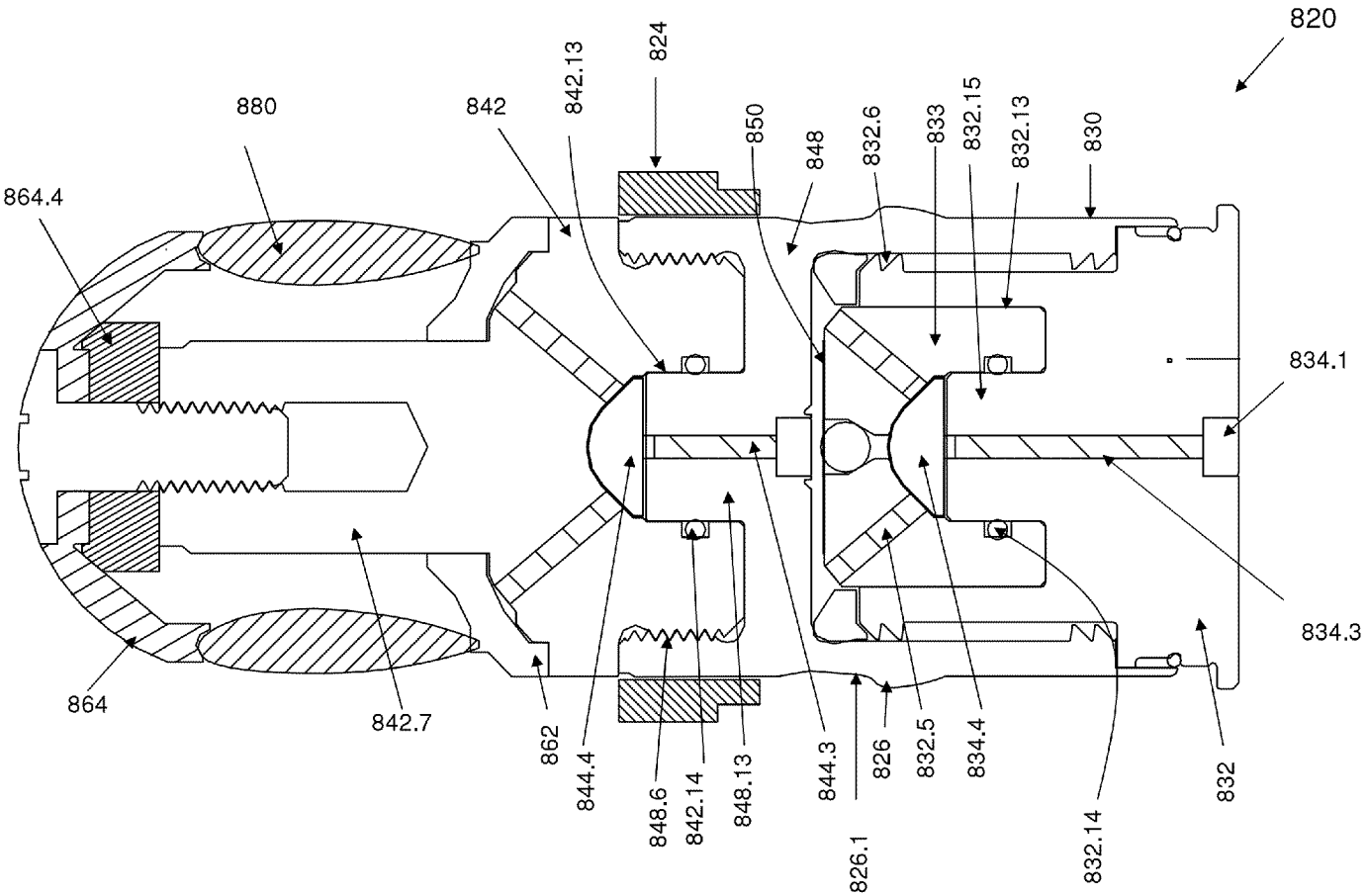
FIG. 16*a* is an elevated cross sectional view of a munition according to another embodiment of the present invention.
Figure 16B:
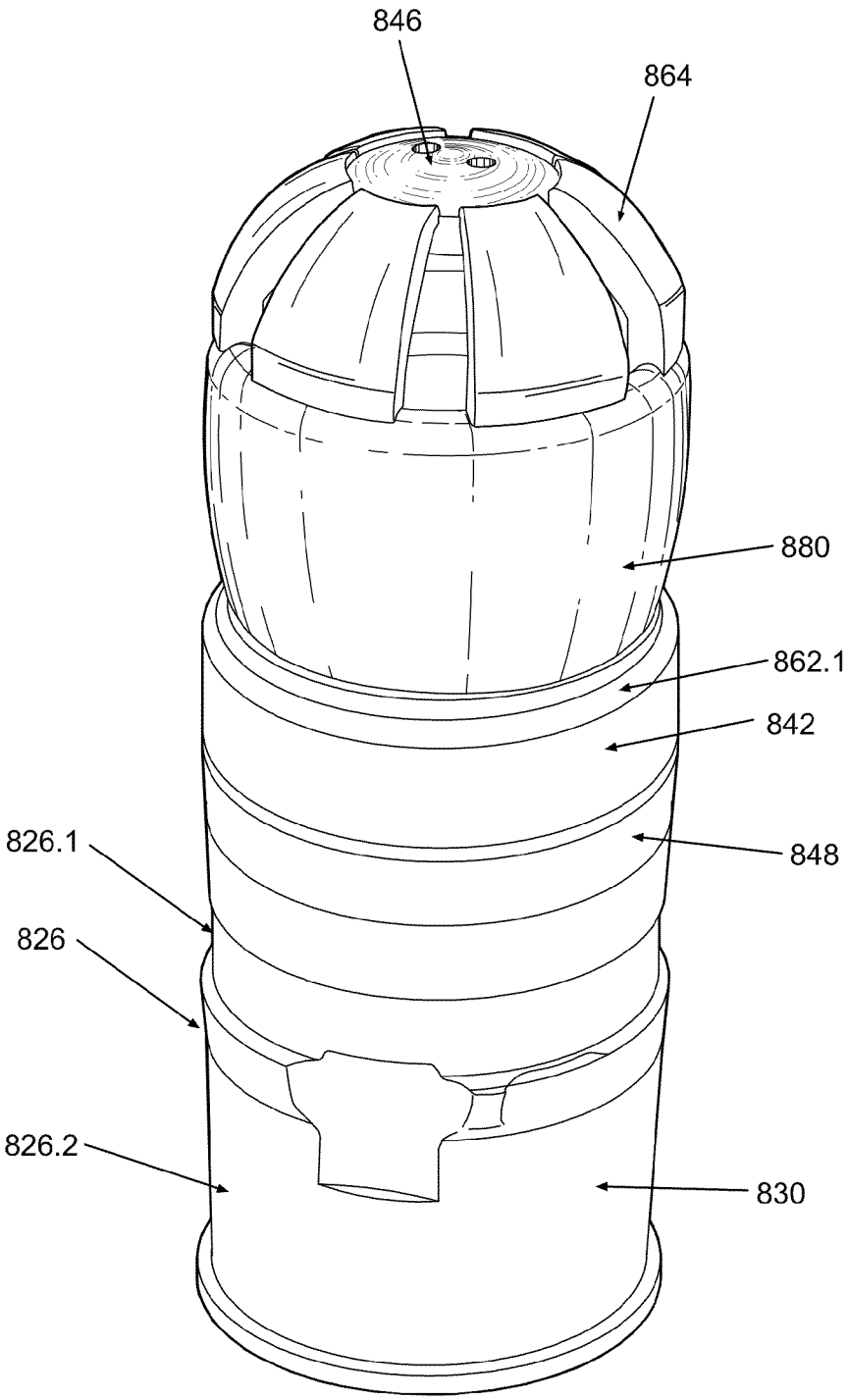
FIG. 16*b* is a side perspective photographic view of the apparatus of FIG. 16*a*, except without the linkage.
Figure 16C:
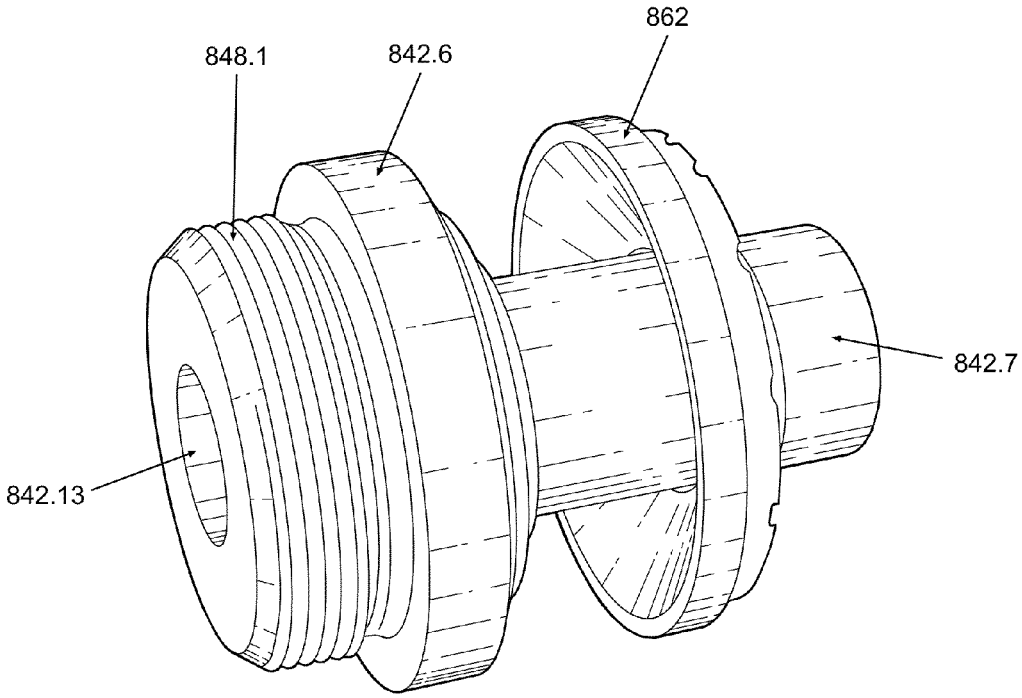
FIG. 16*c* is a perspective photographic representation of a portion of the apparatus of FIG. 16*b*.
Figure 16D:
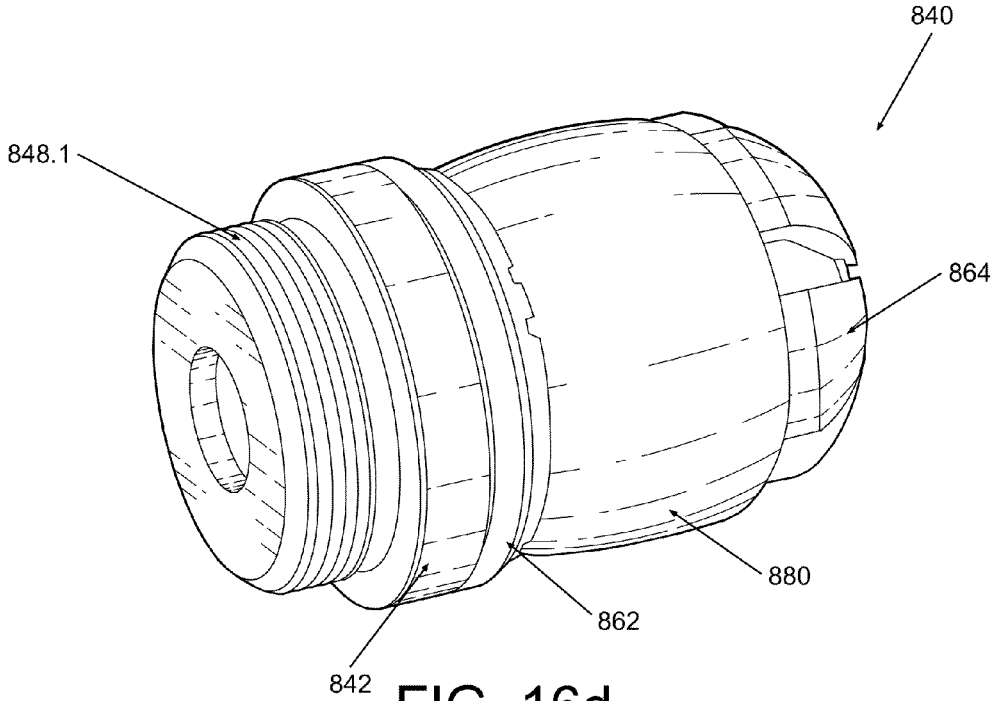
FIG. 16*d* is a perspective photographic representation of a portion of the apparatus of FIG. 16*b*.
Figure 16E:
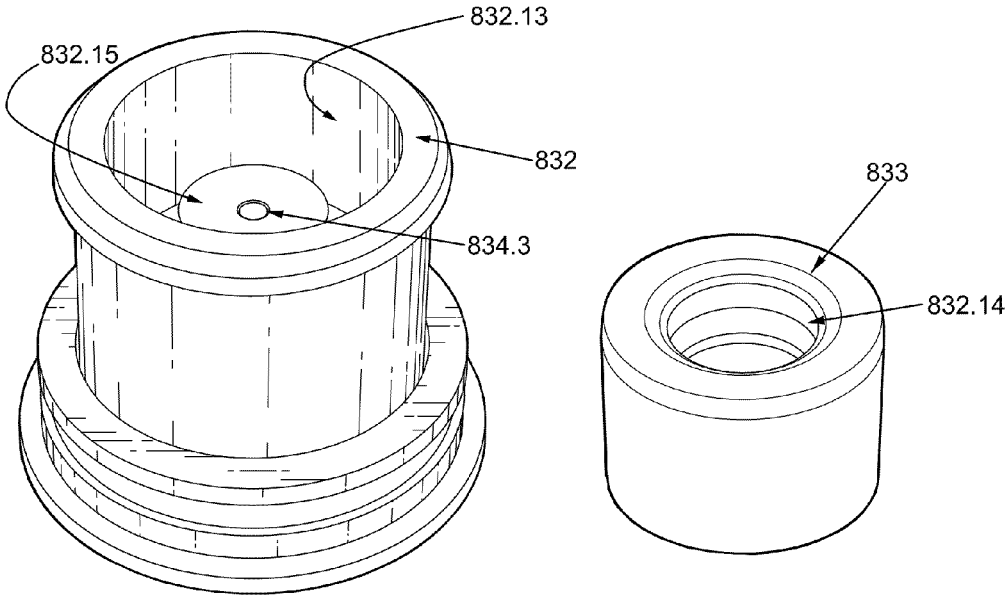
FIG. 16*e* is a perspective photographic representation of a portion of the apparatus of FIG. 16*b*.

FIG. 16*d* shows a launch support assembly 840 according to one embodiment of the present invention. Assembly 840 is a subassembly that is interchangeable on either single shot or automatic loading bases 848. In one embodiment, munition 840 includes a retainer 864, sabot 862, projectile 880 captured between the retainer and sabot, and a base 842 that supports the retainer and sabot. Subassembly 840 can be coupled to a base by coupling means including threads, bayonet-type connections (such as those used with electrical connectors), adhesives, an interference fit, and/or shear pins (such as cold-rolled pins inserted through the walls.

The assembled base 848 further includes a telescoping support body 832 which is useful in reloading applications. Body 832 includes a chamber (or pocket) 832.13 that accepts within it a concave combustion chamber support 833. Support 833 further includes within it an internal pocket that accepts a central projection 832.15 of body 832. An o-ring seal 832.14 is located within a groove of either projection 832.15 or the corresponding pocket of support 833 for sealing of combustion gases.

Figure 16F:
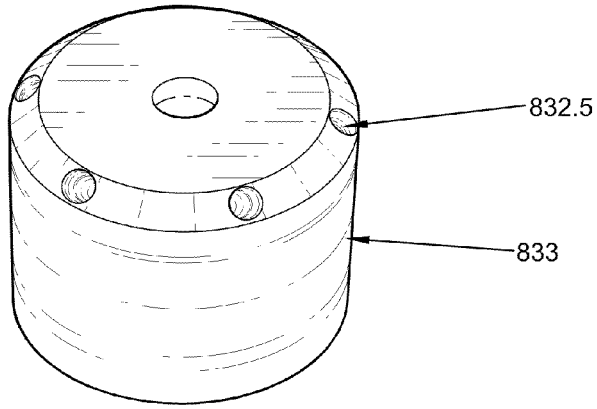
FIG. 16*f* is a perspective photographic representation of a portion of the apparatus of FIG. 16*b*.
Figure 16G:
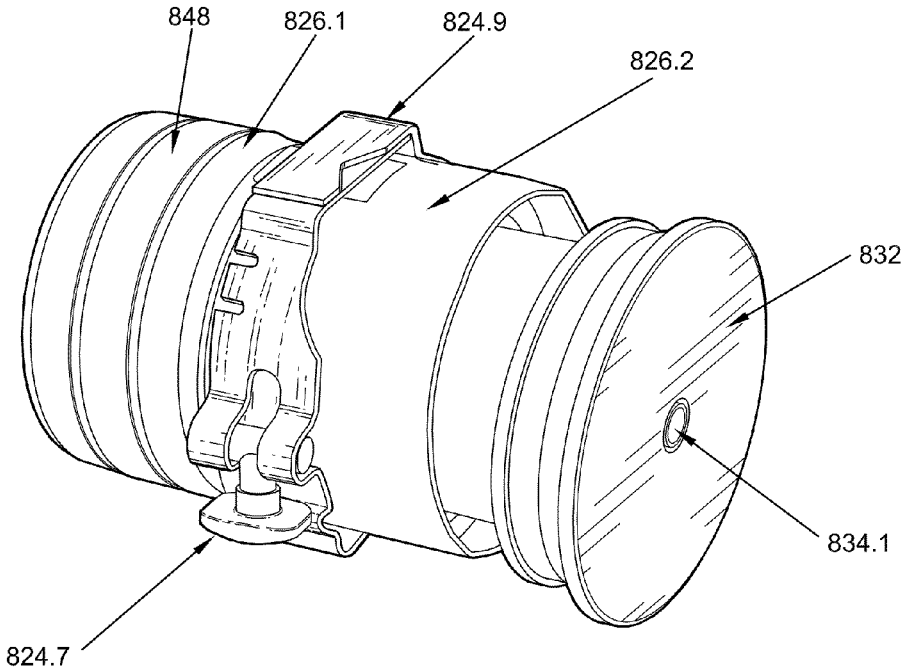
FIG. 16*g* is a perspective photographic representation of a portion of the apparatus of FIG. 16*b*, with the linkage mounted.
Figure 16H:
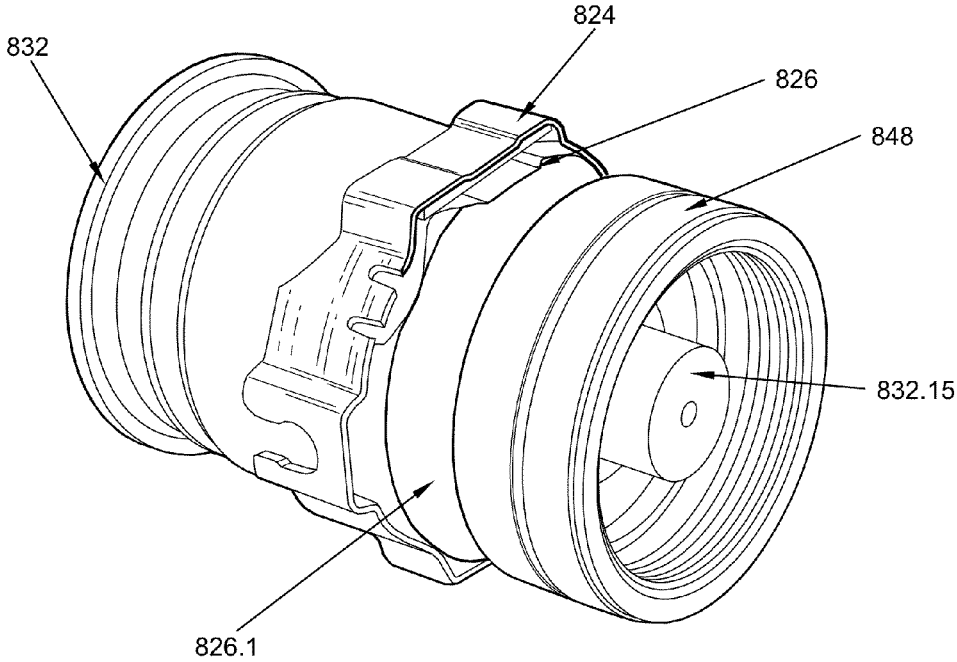
FIG. 16*h* is a perspective photographic representation of a portion of the apparatus of FIG. 16*b*, with the linkage mounted.
Figure 17:
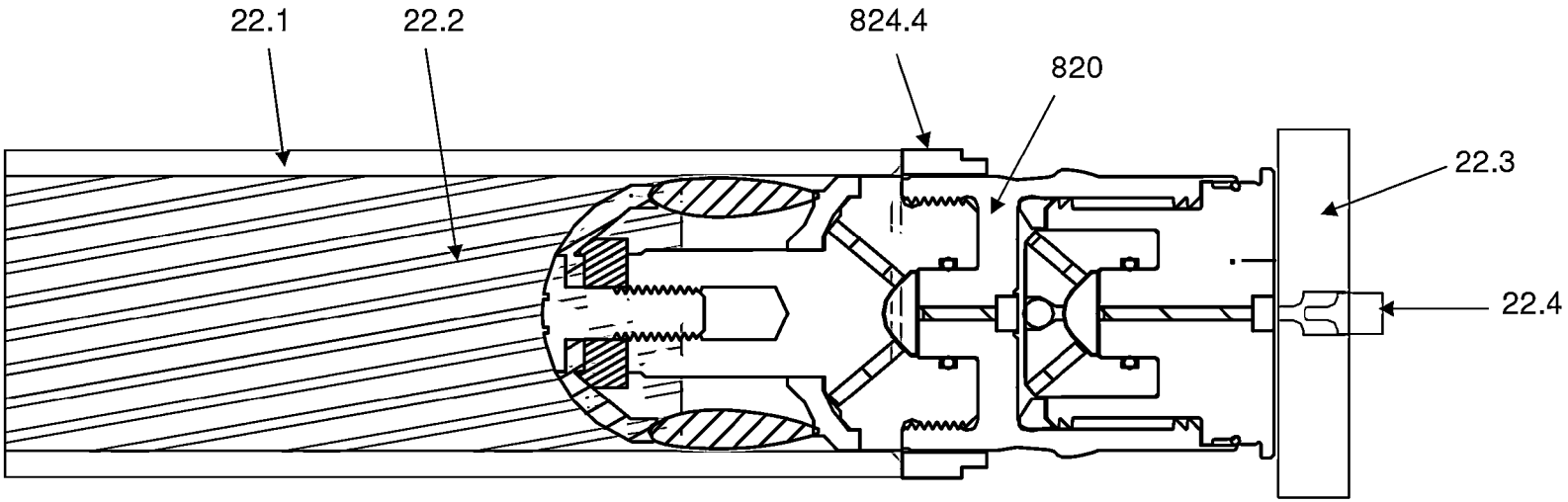
FIG. 17 illustrates a cross sectional view of the round of FIG. 16*a* feeding into a chamber of a gun.

Combustion chamber support 833 preferably defines at least a portion of a combustion chamber to house an explosive charge 834.4. A plurality of gas passageways 832.5 extend outwardly from the combustion chamber (as best seen in FIG. 16*f*). In some embodiments, combustion chamber support 833 is an interference fit and is pressed into pocket 832.13.

In one embodiment, retainer 864 is fabricated from high density polyethylene (HDPE). Projectile 880 is preferably fabricated from Noryl®. Body 842, sabot 862, and combustion chamber support 833 are preferably fabricated from a polymer such as ABS. Base body 848 is fabricated from an aluminum alloy such as 7075-T6. Support body 832 is preferably fabricated from aluminum such as 6020-T8.

FIGS. 17-21 show schematically the firing of a round 820 within a gun barrel 22.1. The following is a description of the firing of ammunition as shown in FIGS. 17-21. Upon being on the bolt face in the ready battery position, latched and ready to be fired, the trigger is pulled. The bolt travels forward until the firing pin 22.4 is released, about 1" from the breech face 22.3.

Figure 18:
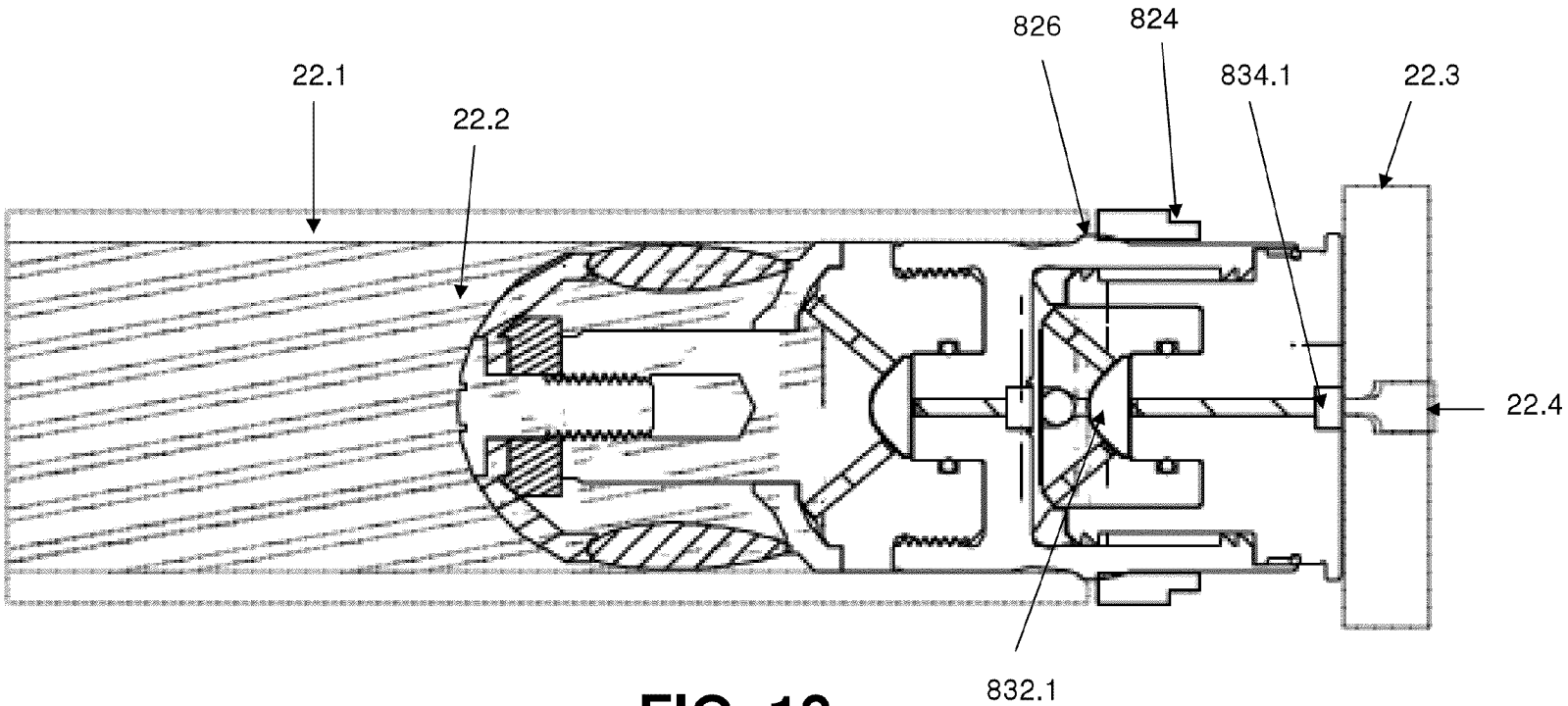
FIG. 18 illustrates a cross sectional view of the round of FIG. 16*a* chambered at the firing point in a gun barrel.

Referring to FIG. 18, the pin strikes the aft telescoping charges primer initiating the propellant; simultaneously an initiation ball 837 is propelled forward to a primer 834.1 for the forward payload propelling charge, and the expanding gas reacts against the telescoping piston to open the action and auto load function the gun.

The forward payload propelling charge expands against the sabot/pusher 862 pushing it forward while fracturing the projectile retainer 864 along one or more separation groove(s) on the central hub of the retainer releasing the sabot and projectile assembly for forward travel.

Figure 19:
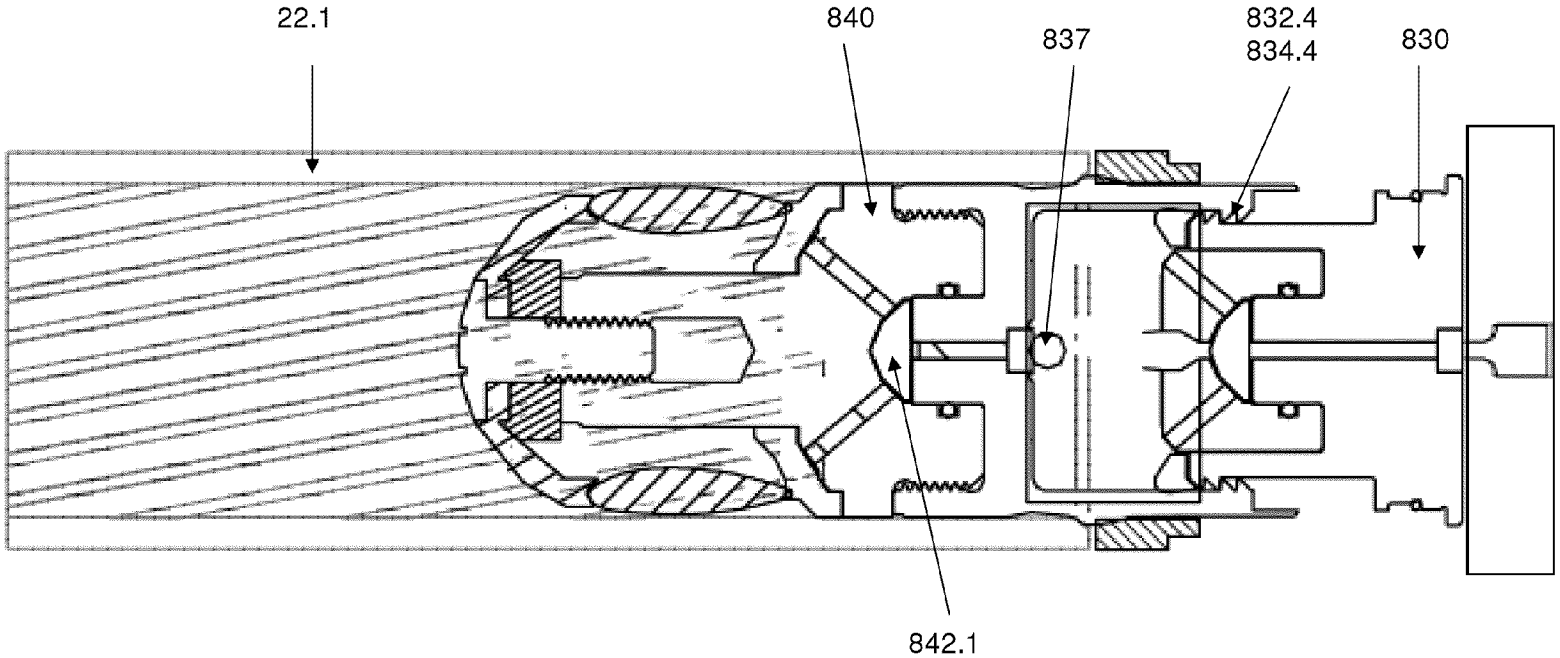
FIG. 19 illustrates a cross sectional view of the round of FIG. 16*a* as the round telescopes and fires the projectile.

Referring to FIG. 19 the sealing and rotating outer diameter 862.1 of sabot 862 seals the propelling gas from the action at the forcing cone of the chamber. The sabot/projectile assembly 160 is pushed along the bore and along the center guide mandrill 842.7, throughout the launch sequence.

The sabot/projectile assembly travels down the bore to the end of the guide mandrill having spin imparted to the assembly by the action of rifling 22.2 in the gun bore 22.1 rotating the sabot 862, which transfers the rotation by the action of drive dogs 862.4 on its forward face engaging slots 888 in the tail 892 of the ring airfoil projectile 880.

Figure 20:
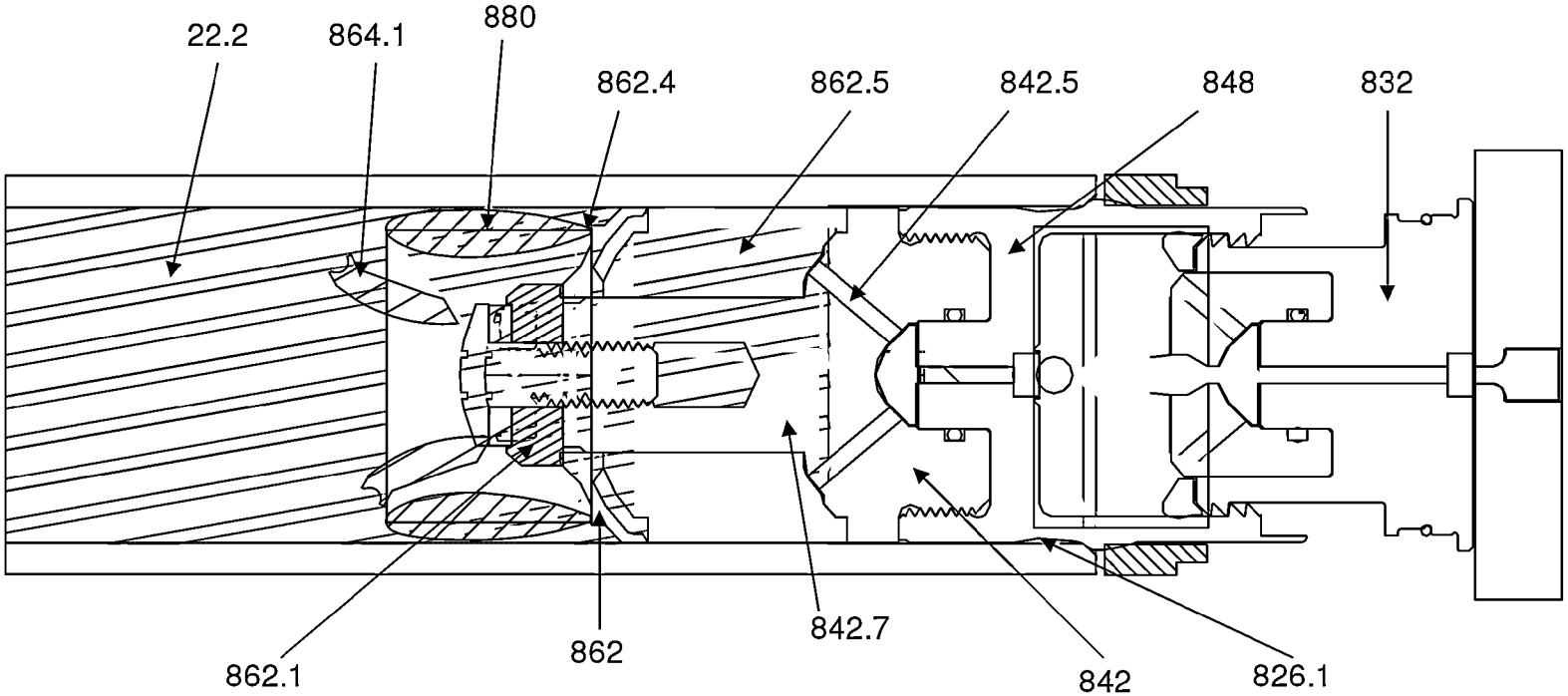
FIG. 20 illustrates a cross sectional view of the round of FIG. 16*a* as the projectile is launched in the barrel chamber and the sabot is stopped.
Figure 21:
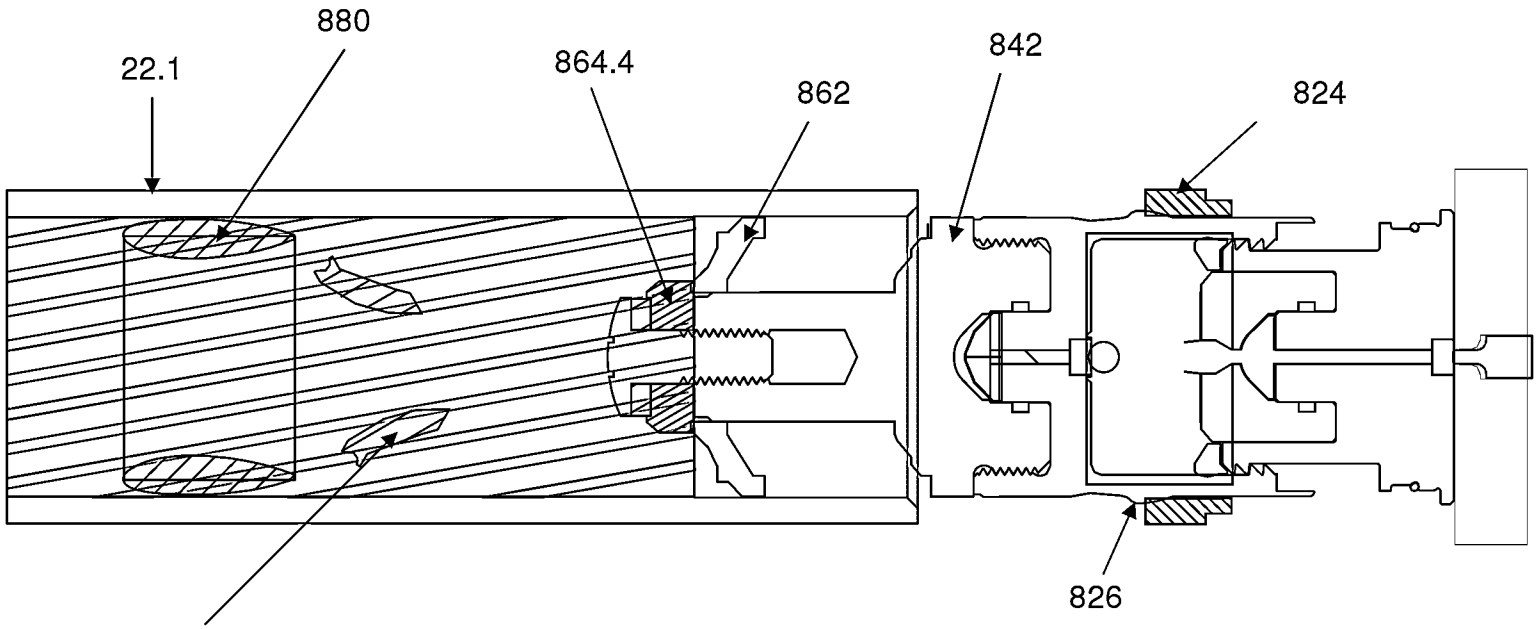
FIG. 21 illustrates a cross sectional view of the round of FIG. 16*a* as the projectile and petals are released to travel down the gun bore and the round begins to eject.

Referring to FIG. 20, the front surface of sabot 862 has contacted the aft facing surface of sabot stop 864.4. Sabot 862 is unable to move past stop 864.4, and comes to rest on rod 842.7. However, projectile 880 is not stopped, and continues to fly within barrel 22.1. In those embodiments having a two-piece sabot assembly, one sabot portion is stopped and retained on rod 842.7, and the other portion continues its flight down the barrel, behind projectile 880.

The projectile rides a turbulent boundary layer of air between its outer diameter and the bore guiding and centering it until it exits the muzzle. The sabot exits the muzzle at greatly reduced energy. The ring airfoil 80 is free to fly towards the target. The automatic loading features of gun 22 remove the fired round 820 from barrel 22.1. Sabot 862, since it is retained on member 842, exists with the spent munition.

Figure 22:
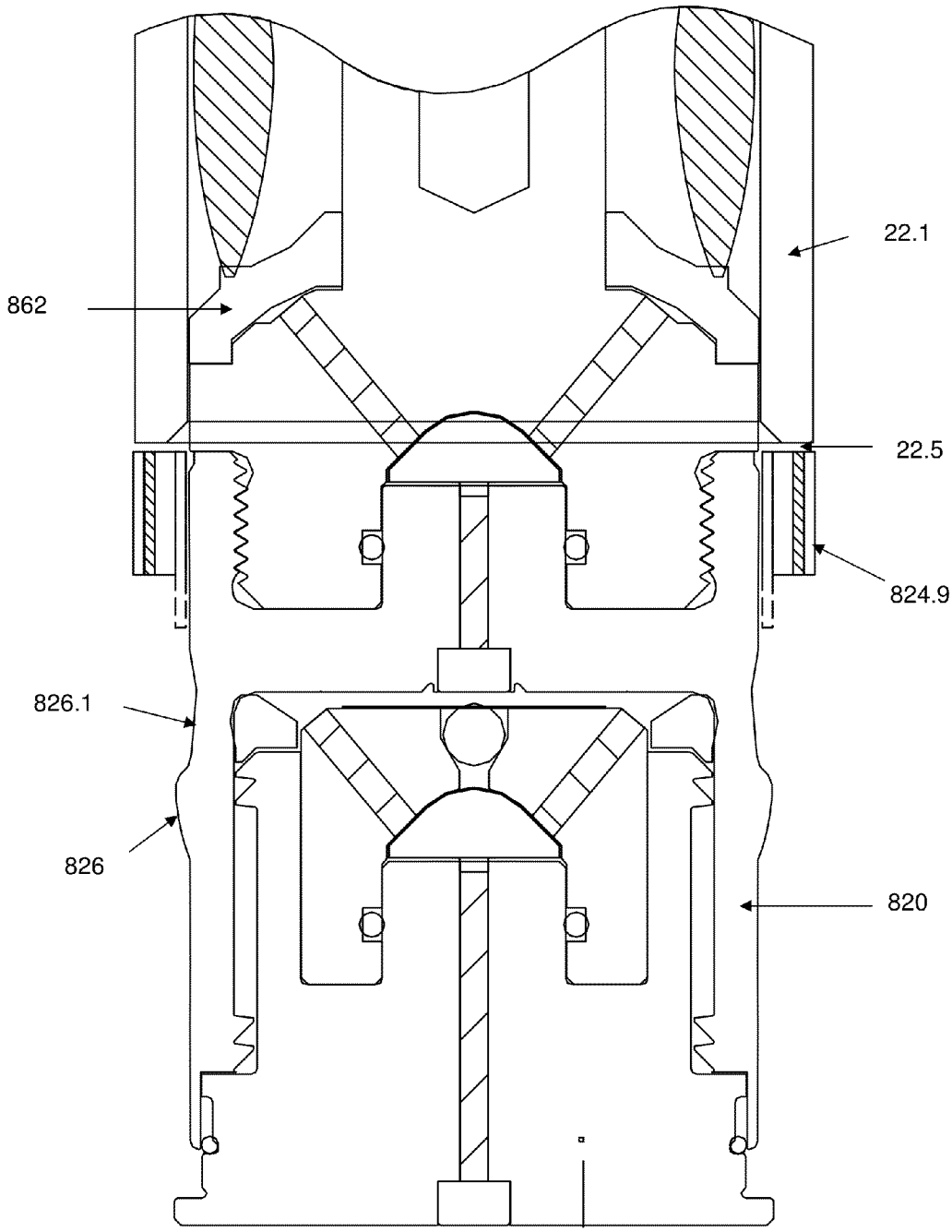
FIG. 22 is a partial cross sectional view of the munition of FIG. 16*a* being automatically loaded into a gun.
Figure 23:
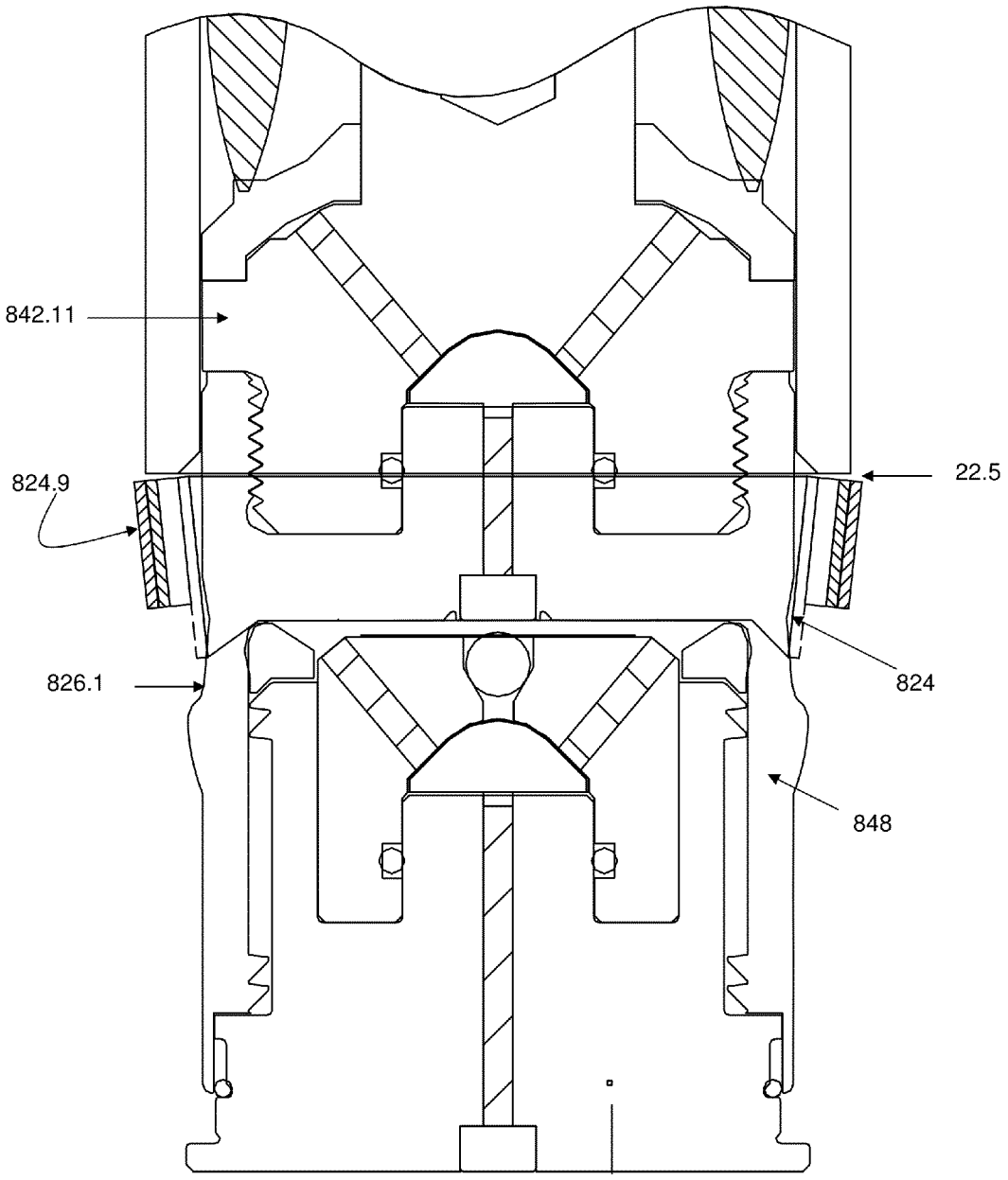
FIG. 23 is a partial cross sectional view of the munition of FIG. 16*a* being automatically loaded into a gun.

FIGS. 22-26 depict the co-action of spring-loaded link assembly 824 with barrel 22.1 during the automatic loading process. As round 820 is brought to the breech of barrel 22.1, the overlapping portions 824.9 of link assembly 824 come into contact with and abut against the end 22.5 of barrel 22.1 (as best seen in FIG. 22). Continued motion of round 820 into barrel 221 causes link 824 to be held in position against barrel end 22.5. As support assembly 848 continue to move into barrel 22.1, the aft most edge of link assembly 824 moves into the region 826.1 of reduced diameter, such that link assembly 824 momentarily takes on a conical shape with reduced tension (as best seen in FIG. 23).

Figure 24:
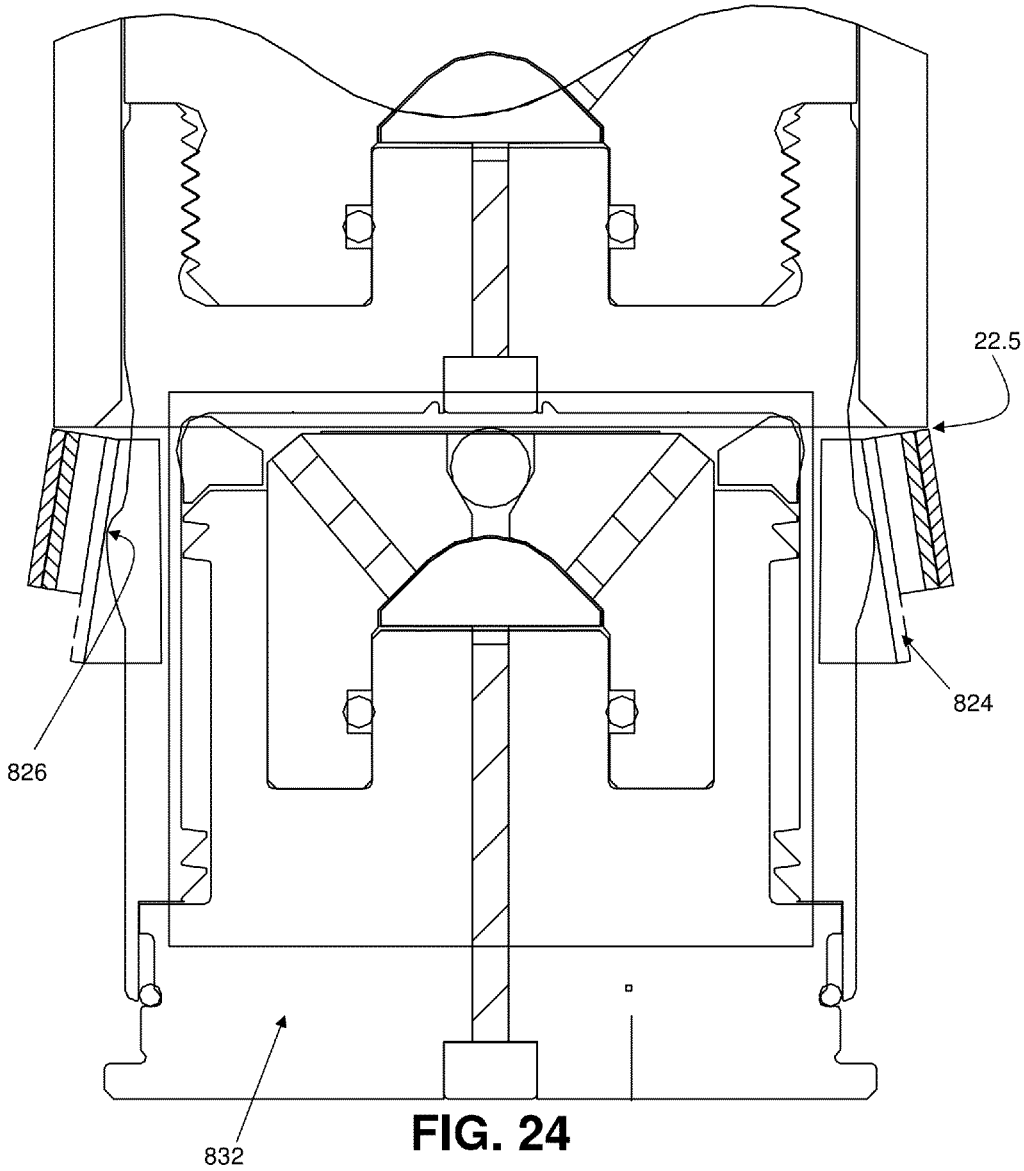
FIG. 24 is a partial cross sectional view of the munition of FIG. 16*a* being automatically loaded into a gun.
Figure 25:
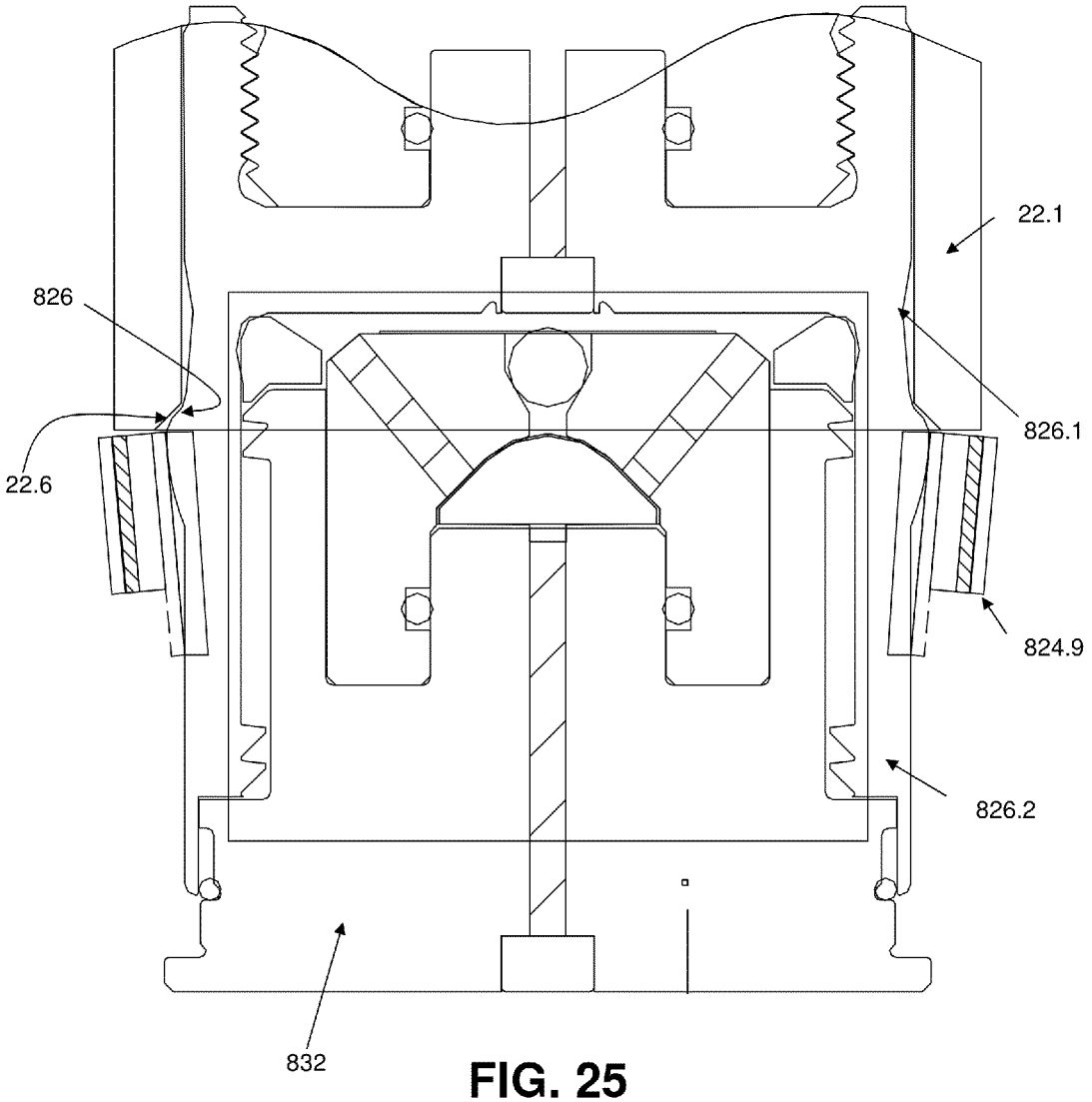
FIG. 25 is a partial cross sectional view of the munition of FIG. 16*a* being automatically loaded into a gun.

FIG. 24 shows that subsequent motion of round 820 into barrel 22.1 continues to move link assembly 824 in sliding motion over shoulder 826 of body 848. Link assembly 824 thereby takes on a conical shape and increased tension, except in a direction different than that as shown in FIG. 23. Referring to FIG. 25, the continued motion of round 820 is stopped by the abutment of the forward edge of ridge 826 against chamfer 22.6 of barrel 22.1.

Figure 26:
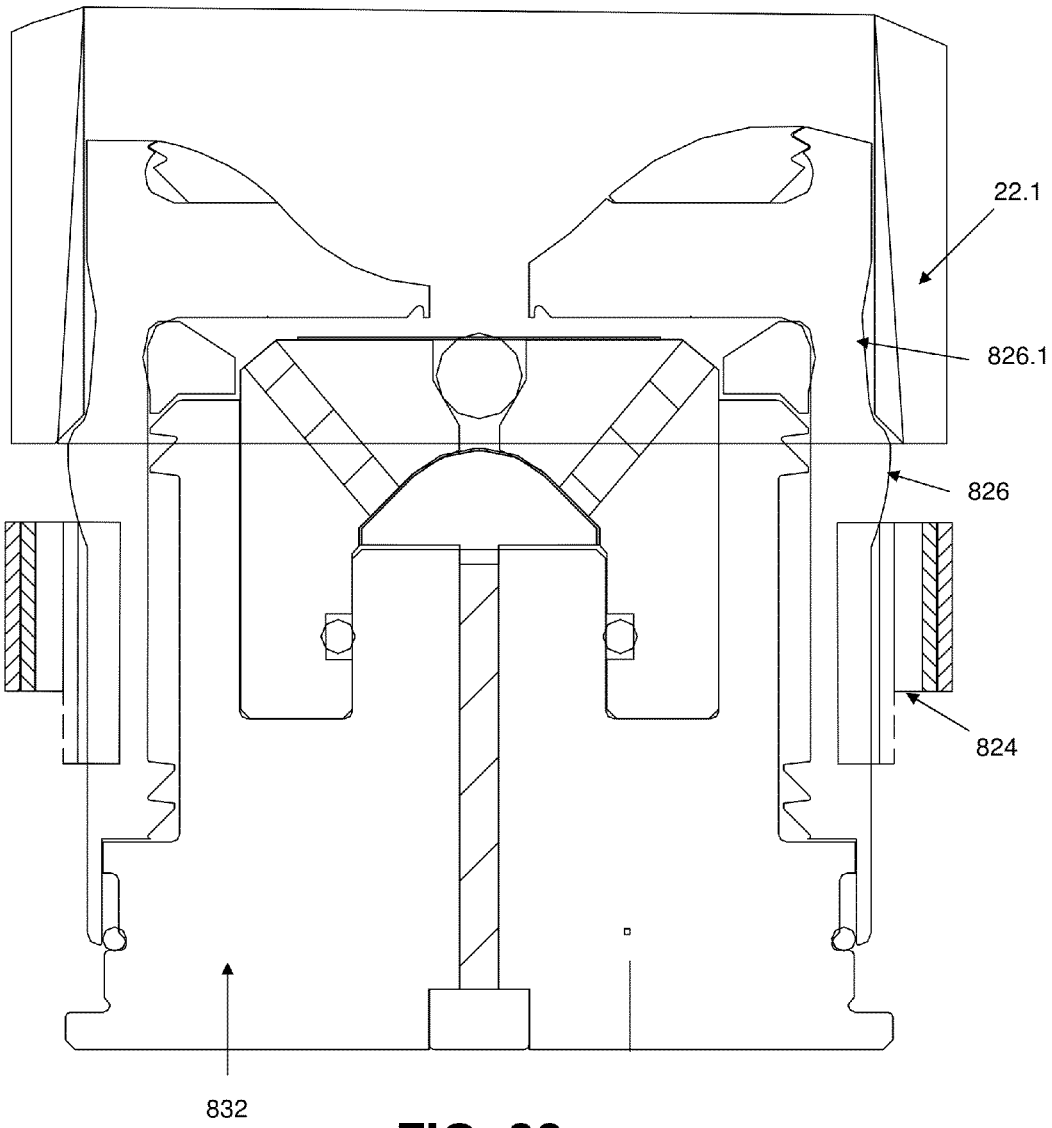
FIG. 26 is a partial cross sectional view of the munition of FIG. 16*a* being automatically loaded into a gun.

In some embodiments, linkage assembly 824 is supported in a conical shape by both shoulder 826 and further by the diameter 826.2 of body 848 immediately aft of shoulder 826. As shown in FIG. 26, linkage 824 continues to slide along the curving and diametrically-reducing aft surface of should 826, and linkage assembly 824 comes to rest on the aft portion of ridge 826 and on the diameter 826.2 of body 848 aft of the ridge.

The following figures are scaled drawings: 9, 10, 11, 12, 13*a*, 14, 15, and 16*a*. All of the munitions shown and described herein are applicable to guns ranging from about 36 mm to about 43 mm. In one embodiment, projectiles 80 weigh about 12 to 14 grams, and are launched with a muzzle exit velocity of about 100 mps. However, the invention is not so limited, and these dimensions and scalings are illustrative examples only.

Although what are shown and described are a variety of munitions including a ring airfoil projectile, the invention is not so limited, and contemplates the use and launching of any kind of projectile, including as non-limiting examples rubber bullets, bean bags, nets, balls, gas canisters, and also including lethal projectiles, and the like.

While the inventions have been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A munition for a gun having a barrel, comprising:

a frangible retainer;

a sabot;

a projectile having an outer diameter that is less than the diameter of the barrel, said projectile being held in compression between said retainer and said sabot; and a body for supporting said sabot and said retainer, said body including at least a portion of a chamber for receiving compressed gas and at least one passageway for directing gas from said chamber to said sabot, said body further including a threaded surface for connection to an interchangeable base.

2. The munition of claim 1 wherein said body and said retainer are threadably coupled.

3. The munition of claim 1 wherein said sabot is in sliding contact with said body.

4. The munition of claim 1 wherein said body includes a centrally located concave chamber and a plurality of gas passageways extending radially outward from said chamber.

5. The munition of claim 1 wherein said body has an outer diameter adapted and configured for sealing contact with the bore of the barrel.

6. The munition of claim 1 wherein said sabot has an outer diameter adapted and configured for sealing contact with the bore of the barrel, the outer diameter of said sabot being greater than about 35 mm and less than about 43 mm.

7. The munition of claim 1 wherein said retainer, said sabot, and said projectile are fabricated from a polymer.

8. The munition of claim 1 which further comprises a base having a threaded surface for coupling to the threaded surface of said body, said base including a primer, said base being adapted a configured for a non-automatic gun.

9. The munition of claim 1 which further comprises a base having a threaded surface for coupling to the threaded surface of said body, said base including a telescoping member having a primer, said base and said telescoping member being adapted a configured for an automatically reloading gun.

* * * * *